US010658762B2

(12) United States Patent
Paulotto et al.

(10) Patent No.: US 10,658,762 B2
(45) Date of Patent: May 19, 2020

(54) MULTI-BAND MILLIMETER WAVE ANTENNA ARRAYS

(71) Applicant: Apple Inc., Cupertino, CA (US)

(72) Inventors: Simone Paulotto, Redwood City, CA (US); Basim H. Noori, San Jose, CA (US); Matthew A. Mow, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 161 days.

(21) Appl. No.: 15/650,638

(22) Filed: Jul. 14, 2017

(65) Prior Publication Data

US 2019/0020121 A1 Jan. 17, 2019

(51) Int. Cl.
*H01Q 1/38* (2006.01)
*H01Q 21/06* (2006.01)
(Continued)

(52) U.S. Cl.
CPC ..... *H01Q 21/065* (2013.01); *H01Q 1/243* (2013.01); *H01Q 1/38* (2013.01); *H01Q 5/392* (2015.01);
(Continued)

(58) Field of Classification Search
CPC ..... H01Q 5/357; H01Q 5/364; H01Q 5/371; H01Q 1/27; H01Q 1/3233; H01Q 9/0407;
(Continued)

(56) References Cited

U.S. PATENT DOCUMENTS 6,191,740 B1 2/2001 Kates et al.
7,236,070 B2 6/2007 Ajioka et al.
(Continued)

FOREIGN PATENT DOCUMENTS

JP 2017085289 A * 5/2017
KR 101014347 2/2011
(Continued)

OTHER PUBLICATIONS

Noori et al., U.S. Appl. No. 15/138,684, filed Apr. 26, 2016.
(Continued)

*Primary Examiner* — Dieu Hien T Duong
(74) *Attorney, Agent, or Firm* — Treyz Law Group, P.C.; Michael H. Lyons

(57) ABSTRACT

An electronic device may be provided with wireless circuitry that includes a phased antenna array. The array may include first, second, and third rings of antennas on a dielectric substrate that cover respective first, second, and third communications bands greater than 10 GHz. The second ring of antennas may surround the first ring of antennas. The third ring of antennas may be formed over the second ring of antennas. Parasitic elements may be formed over the first ring of antennas to broaden the bandwidth of the first ring of antennas. Beam steering circuitry may be coupled to the rings of antennas. Control circuitry may control the beam steering circuitry to steer a beam of wireless signals in one or more of the first, second, and third communications bands. The array may exhibit relatively uniform antenna gain regardless of the direction in which the beam is steered.

19 Claims, 13 Drawing Sheets

(51) Int. Cl.

| | |
|---|---|
| ***H01Q 21/28*** | (2006.01) |
| ***H01Q 1/24*** | (2006.01) |
| ***H01Q 9/04*** | (2006.01) |
| ***H01Q 5/42*** | (2015.01) |
| ***H01Q 5/40*** | (2015.01) |
| ***H01Q 5/392*** | (2015.01) |
| *H01Q 21/24* | (2006.01) |

(52) U.S. Cl.
CPC ..... *H01Q 5/40* (2015.01); *H01Q 5/42* (2015.01); *H01Q 9/0414* (2013.01); *H01Q 9/0435* (2013.01); *H01Q 9/0485* (2013.01); *H01Q 21/28* (2013.01); *H01Q 21/24* (2013.01)

(58) Field of Classification Search
CPC .. H01Q 9/0442; H01Q 13/106; H01Q 21/065; H01Q 1/38; H01Q 21/28; H01Q 1/243; H01Q 9/0435; H01Q 5/42; H01Q 9/0414; H01Q 5/40; H01Q 5/392
See application file for complete search history.

(56) References Cited

U.S. PATENT DOCUMENTS

| | | | | |
|---|---|---|---|---|
| 7,595,759 | B2 * | 9/2009 | Schlub | H01Q 1/243 343/702 |
| 8,102,330 | B1 | 1/2012 | Albers | |
| 8,730,110 | B2 | 5/2014 | Rao | |
| 9,537,216 | B1 | 1/2017 | Kontopidis et al. | |
| 9,667,290 | B2 | 5/2017 | Ouyang et al. | |
| 2005/0110685 | A1 | 5/2005 | du Toit | |
| 2006/0267844 | A1 | 11/2006 | Yanagi et al. | |
| 2008/0316121 | A1 * | 12/2008 | Hobson | H01Q 1/243 343/702 |
| 2010/0090902 | A1 | 4/2010 | Thompson et al. | |
| 2014/0203995 | A1 * | 7/2014 | Romney | H01Q 19/17 343/893 |
| 2014/0210486 | A1 * | 7/2014 | Dijkstra | H01Q 3/28 324/612 |
| 2015/0194730 | A1 * | 7/2015 | Sudo | H01Q 9/045 343/905 |
| 2015/0333407 | A1 * | 11/2015 | Yamagajo | H01Q 9/0414 343/905 |
| 2016/0308626 | A1 | 10/2016 | Mow et al. | |
| 2017/0110787 | A1 | 4/2017 | Ouyang et al. | |
| 2017/0117754 | A1 | 4/2017 | Noori et al. | |
| 2017/0256867 | A1 * | 9/2017 | Ding | H01Q 21/0075 |
| 2018/0159203 | A1 | 6/2018 | Baks et al. | |
| 2018/0198204 | A1 | 7/2018 | Kovacic | |

FOREIGN PATENT DOCUMENTS

| | | | |
|---|---|---|---|
| KR | 101014347 | B1 | 2/2011 |
| WO | 2016116053 | A1 | 7/2016 |

OTHER PUBLICATIONS

Noori et al., U.S. Appl. No. 15/138,689, filed Apr. 26, 2016.
Mow et al., U.S. Appl. No. 15/217,805, filed Jul. 22, 2016.
Paulotto et al., U.S. Appl. No. 15/650,627, filed Jul. 14, 2017.
Paulotto et al., U.S. Appl. No. 15/650,689, filed Jul. 17, 2017.

* cited by examiner

MULTI-BAND MILLIMETER WAVE ANTENNA ARRAYS

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths, but may raise significant challenges. For example, millimeter wave communications are often line-of-sight communications and can be characterized by substantial attenuation during signal propagation.

It would therefore be desirable to be able to provide electronic devices with improved wireless communications circuitry such as communications circuitry that supports communications at frequencies greater than 10 GHz.

SUMMARY

An electronic device may be provided with wireless circuitry. The wireless circuitry may include one or more antennas and transceiver circuitry such as millimeter wave transceiver circuitry. The antennas may be organized in a phased antenna array. The phased antenna array may transmit and receive a beam of wireless signals in frequency bands between 10 GHz and 300 GHz. Beam steering circuitry may be coupled to each of the antennas in the phased antenna array. Control circuitry in the electronic device may control the beam steering circuitry to steer a direction (orientation) of the beam.

The phased antenna array may include a dielectric substrate and first and second sets of antennas on the dielectric substrate. The first set of antennas may transmit and receive wireless signals in a first communications band between 10 GHz and 300 GHz. The second set of antennas may transmit and receive wireless signals in a second communications band between 10 GHz and 300 GHz. The first and second sets of antennas may, for example, include patch antennas having corresponding patch antenna resonating elements. The second communications band may include frequencies that are lower than the first communications band. The second set of antennas may surround the first set of antennas on the dielectric substrate. For example, the first set of antennas may be arranged in a first ring of antennas and the second set of antennas may be arranged in a second ring of antennas surrounding the first ring. Each antenna in the first ring may be located at a first distance from a given point on the dielectric substrate. Each antenna in the second ring may be located at a second distance from the given point that is greater than the first distance. The antennas in the first ring may be angularly offset with respect to the antennas in the second ring about the given point on the dielectric substrate.

A set of parasitic antenna resonating elements may be formed over the first set of antennas in the array and may serve to broaden a bandwidth of the first set of antennas. The set of parasitic antenna resonating elements may include cross-shaped conductive patches having arms that overlap with antenna feed terminals on the first set of antennas. A third set of antennas may be formed on the dielectric substrate and may transmit and receive wireless signals in a third communications band between 10 GHz and 300 GHz. The third communications band may include frequencies that are higher than the second communications band and lower than the first communications band. As an example, the first communications band may include frequencies from 57 GHz to 71 GHz, the second communications band may include frequencies from 27.5 GHz to 28.5 GHz, and the third communications band may include frequencies from 37 GHz to 41 GHz. The third set of antennas may include patch antenna resonating elements formed over the second set of antennas in the array.

The control circuitry may control the beam steering circuitry to steer a beam of wireless signals in one or more of the first, second, and third communications bands in a particular directions. The phased antenna array may exhibit uniform antenna gain regardless of the direction in which the beam is steered.

DETAILED DESCRIPTION

Figure 1:
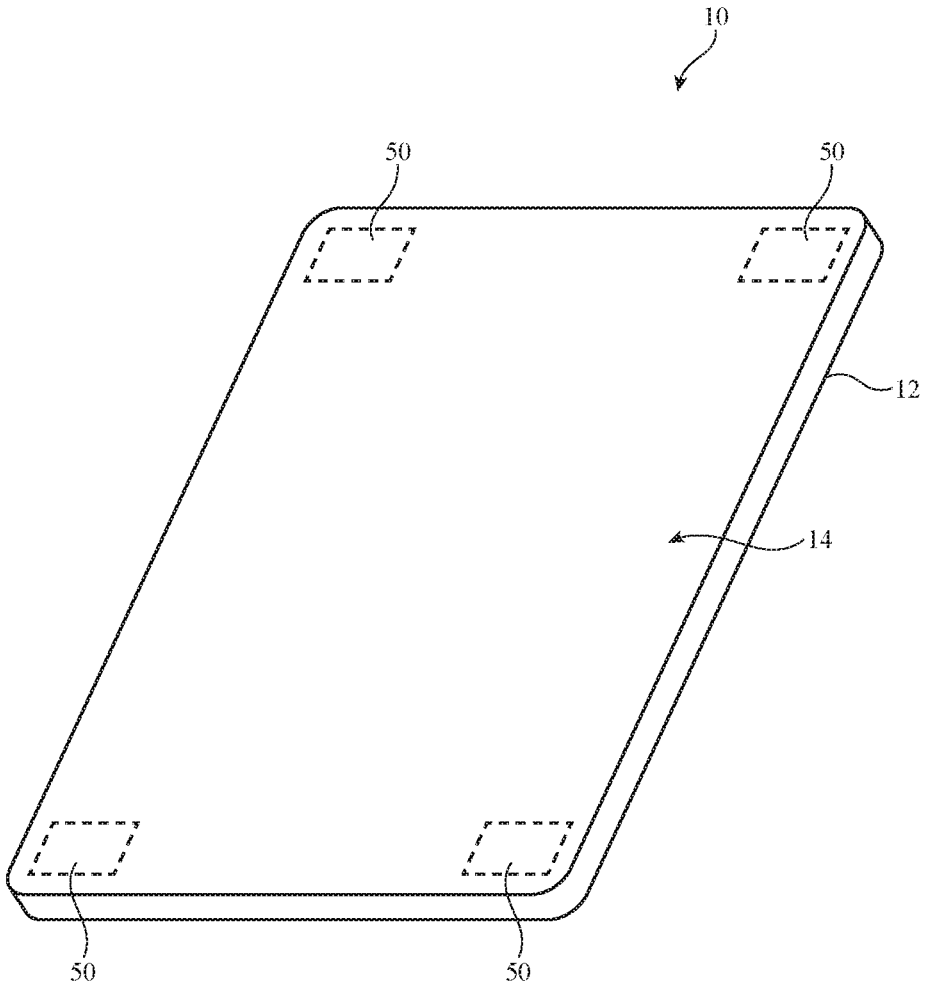
FIG. 1 is a perspective view of an illustrative electronic device with wireless communications circuitry in accordance with an embodiment.

An electronic device such as electronic device 10 of FIG. 1 may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. If desired, device 10 may also contain wireless communications circuitry for handling satellite navigation system signals, cellular telephone signals, local wireless area network signals, near-field communications, light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station, a desktop computer, a keyboard, a gaming controller, a computer mouse, a mousepad, a trackpad or touchpad, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

As shown in FIG. 1, device 10 may include a display such as display 14. Display 14 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass, clear plastic, sapphire, or other transparent dielectric. Openings may be formed in the display cover layer. For example, openings may be formed in the display cover layer to accommodate one or more buttons, sensor circuitry such as a fingerprint sensor or light sensor, ports such as a speaker port or microphone port, etc. Openings may be formed in housing 12 to form communications ports (e.g., an audio jack port, a digital data port, charging port, etc.). Openings in housing 12 may also be formed for audio components such as a speaker and/or a microphone.

Antennas may be mounted in housing 12. If desired, some of the antennas (e.g., antenna arrays that may implement beam steering, etc.) may be mounted under an inactive border region of display 14 (see, e.g., illustrative antenna locations 50 of FIG. 1). Antennas may also operate through dielectric-filled openings in the rear of housing 12 or elsewhere in device 10.

To avoid disrupting communications when an external object such as a human hand or other body part of a user blocks one or more antennas, antennas may be mounted at multiple locations in housing 12. Sensor data such as proximity sensor data, real-time antenna impedance measurements, signal quality measurements such as received signal strength information, and other data may be used in determining when one or more antennas is being adversely affected due to the orientation of housing 12, blockage by a user's hand or other external object, or other environmental factors. Device 10 can then switch one or more replacement antennas into use in place of the antennas that are being adversely affected.

Antennas may be mounted at the corners of housing 12 (e.g., in corner locations 50 of FIG. 1 and/or in corner locations on the rear of housing 12), along the peripheral edges of housing 12, on the rear of housing 12, under the display cover glass or other dielectric display cover layer that is used in covering and protecting display 14 on the front of device 10, under a dielectric window on a rear face of housing 12 or the edge of housing 12, or elsewhere in device 10.

Figure 2:
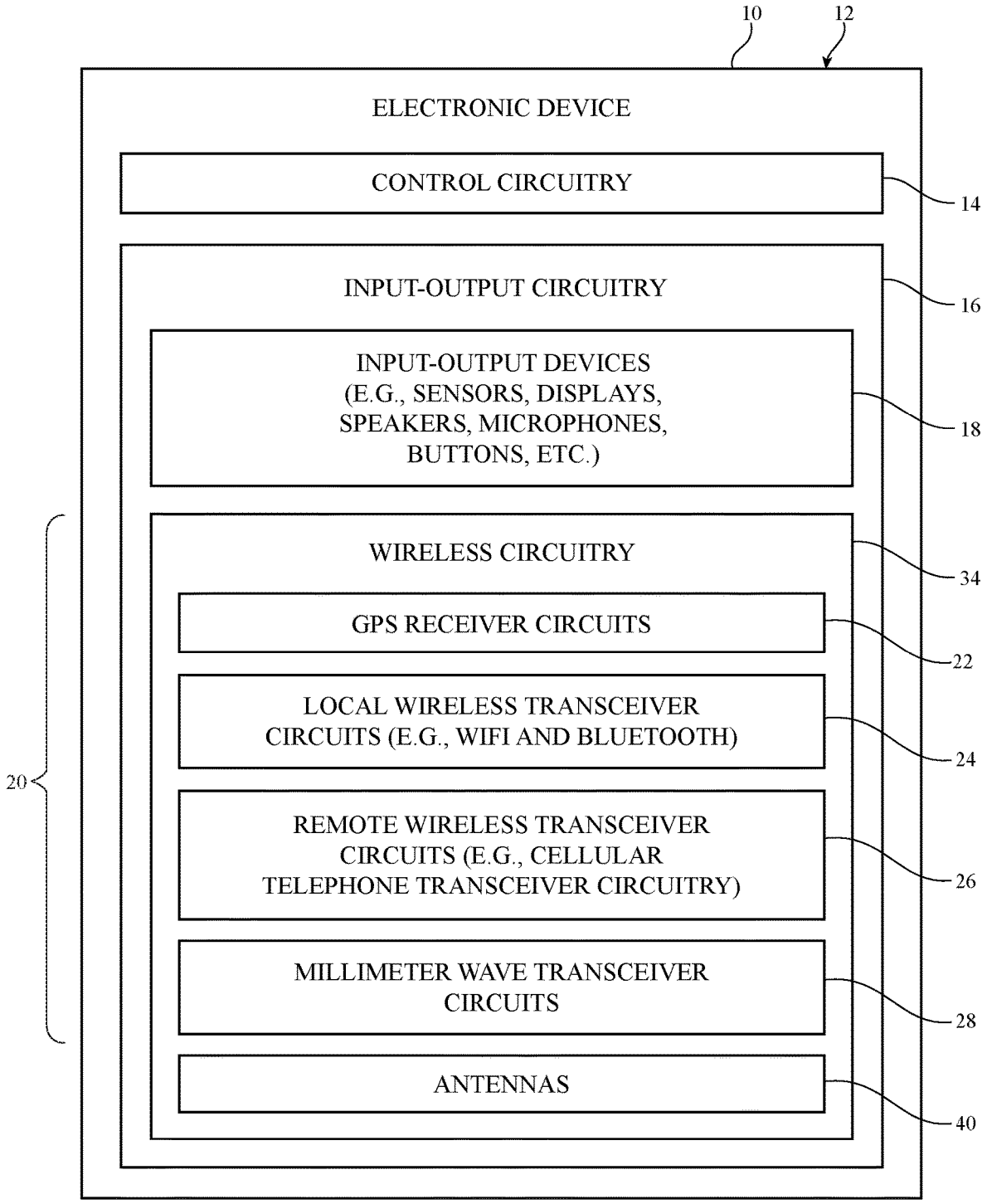
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include storage and processing circuitry such as control circuitry 14. Control circuitry 14 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10, such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, etc.

Device 10 may include input-output circuitry 16. Input-output circuitry 16 may include input-output devices 18.

Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include transceiver circuitry 20 for handling various radio-frequency communications bands. For example, circuitry 34 may include transceiver circuitry 22, 24, 26, and 28.

Transceiver circuitry 24 may be wireless local area network transceiver circuitry. Transceiver circuitry 24 may handle 2.4 GHz and 5 GHz bands for WiFi® (IEEE 802.11) communications and may handle the 2.4 GHz Bluetooth® communications band.

Circuitry 34 may use cellular telephone transceiver circuitry 26 for handling wireless communications in frequency ranges such as a communications band from 700 to 960 MHz, a communications band from 1710 to 2170 MHz, and a communications from 2300 to 2700 MHz or other communications bands between 700 MHz and 4000 MHz or other suitable frequencies (as examples). Circuitry 26 may handle voice data and non-voice data.

Millimeter wave transceiver circuitry 28 (sometimes referred to as extremely high frequency transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.11ad communications at 60 GHz and/or $5^{th}$ generation mobile networks or $5^{th}$ generation wireless systems (5G) communications bands between 27 GHz and 90 GHz. If desired, circuitry 28 may support communications at multiple frequency bands between 10 GHz and 300 GHz such as a first band from 27.5 GHz to 28.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Extremely high frequency (EHF) wireless transceiver circuitry 28 may convey signals over these short distances that travel between transmitter and receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from loop antenna structures, patch antenna structures, inverted-F antenna structures, slot antenna structures, planar inverted-F antenna structures, monopoles, dipoles, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can include phased antenna arrays for handling millimeter and centimeter wave communications.

Transmission line paths may be used to route antenna signals within device 10. For example, transmission line paths may be used to couple antenna structures 40 to transceiver circuitry 20. Transmission lines in device 10 may include coaxial cable paths, microstrip transmission lines, stripline transmission lines, edge-coupled microstrip transmission lines, edge-coupled stripline transmission lines, waveguide structures, transmission lines formed from combinations of transmission lines of these types, etc. Filter circuitry, switching circuitry, impedance matching circuitry, and other circuitry may be interposed within the transmission lines, if desired.

Device 10 may contain multiple antennas 40. The antennas may be used together or one of the antennas may be switched into use while other antenna(s) are switched out of use. If desired, control circuitry 14 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40.

In some configurations, antennas 40 may include antenna arrays (e.g., phased antenna arrays to implement beam steering functions). For example, the antennas that are used in handling millimeter and centimeter wave signals for transceiver circuits 28 may be implemented as one or more phased antenna arrays. The radiating elements in a phased antenna array for supporting millimeter wave communications may be patch antennas, dipole antennas, Yagi antennas (sometimes referred to as beam antennas), or other suitable antenna elements. Transceiver circuitry 28 may be integrated with the phased antenna arrays to form integrated phased antenna array and transceiver circuit modules if desired.

In devices such as handheld devices, the presence of an external object such as the hand of a user or a table or other surface on which a device is resting has a potential to block wireless signals such as millimeter and centimeter wave signals. Accordingly, it may be desirable to incorporate multiple phased antenna arrays into device 10, each of which is placed in a different location within device 10. With this type of arrangement, an unblocked phased antenna array may be switched into use and, once switched into use, the phased antenna array may use beam steering to optimize wireless performance. Configurations in which antennas from one or more different locations in device 10 are operated together may also be used.

Figure 3:
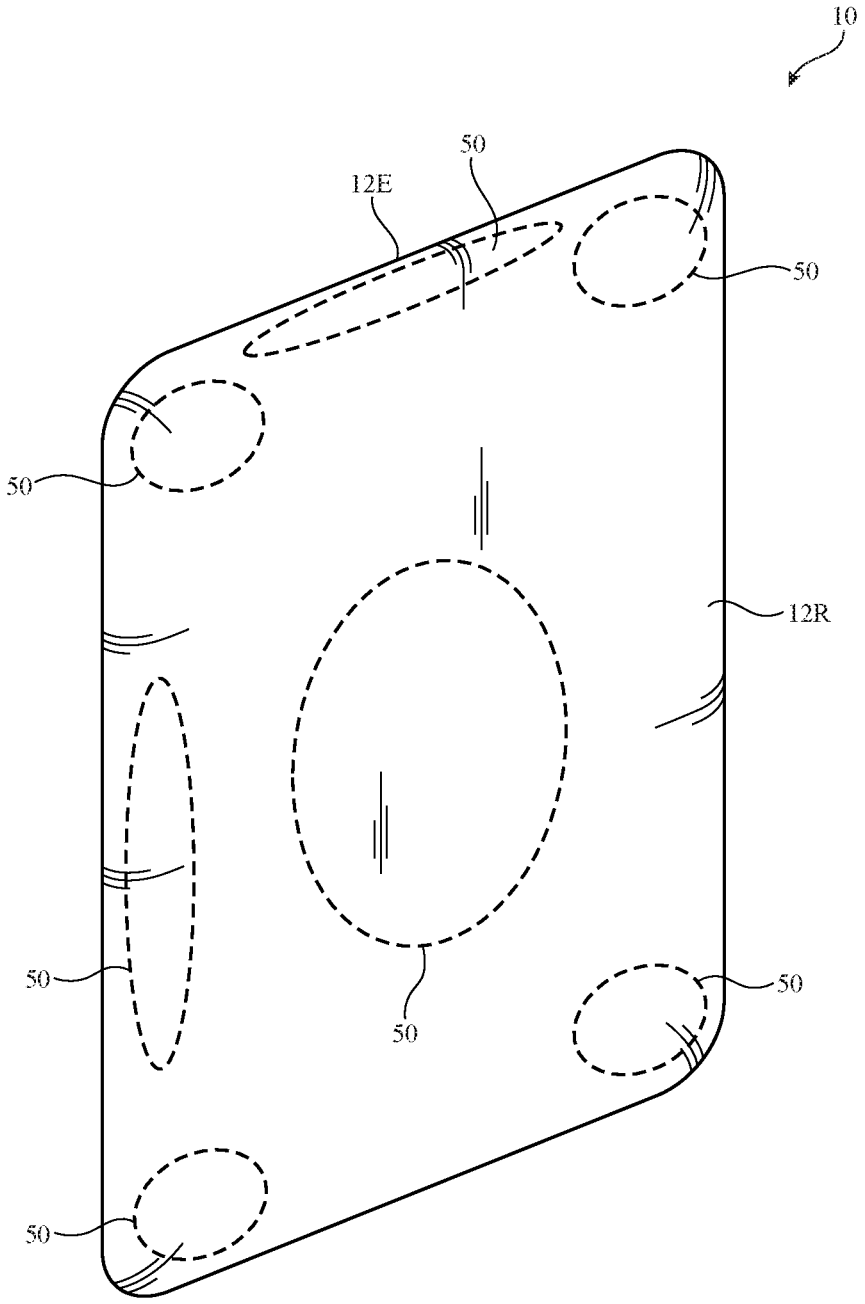
FIG. 3 is a rear perspective view of an illustrative electronic device showing illustrative locations at which antenna arrays for communications at frequencies greater than 10 GHz may be located in accordance with an embodiment.

FIG. 3 is a perspective view of electronic device 10 showing illustrative locations 50 on the rear of housing 12 in which antennas 40 (e.g., single antennas and/or phased antenna arrays for use with wireless circuitry 34 such as wireless transceiver circuitry 28) may be mounted in device 10. Antennas 40 may be mounted at the corners of device 10, along the edges of housing 12 such as edge 12E, on upper and lower portions of rear housing portion (wall) 12R, in the center of rear housing wall 12R (e.g., under a dielectric window structure or other antenna window in the center of rear housing 12R), at the corners of rear housing wall 12R (e.g., on the upper left corner, upper right corner, lower left corner, and lower right corner of the rear of housing 12 and device 10), etc.

In configurations in which housing 12 is formed entirely or nearly entirely from a dielectric, antennas 40 may transmit and receive antenna signals through any suitable portion of the dielectric. In configurations in which housing 12 is formed from a conductive material such as metal, regions of the housing such as slots or other openings in the metal may be filled with plastic or other dielectric. Antennas 40 may be mounted in alignment with the dielectric in the openings. These openings, which may sometimes be referred to as dielectric antenna windows, dielectric gaps, dielectric-filled openings, dielectric-filled slots, elongated dielectric opening regions, etc., may allow antenna signals to be transmitted to external equipment from antennas 40 mounted within the interior of device 10 and may allow internal antennas 40 to receive antenna signals from external equipment. In another suitable arrangement, antennas 40 may be mounted on the exterior of conductive portions of housing 12.

In devices with phased antenna arrays, circuitry 34 may include gain and phase adjustment circuitry that is used in adjusting the signals associated with each antenna 40 in an array (e.g., to perform beam steering). Switching circuitry may be used to switch desired antennas 40 into and out of use. Each of locations 50 may include multiple antennas 40 (e.g., a set of three antennas or more than three or fewer than three antennas in a phased antenna array) and, if desired, one or more antennas from one of locations 50 may be used in transmitting and receiving signals while using one or more antennas from another of locations 50 in transmitting and receiving signals.

Figure 4:
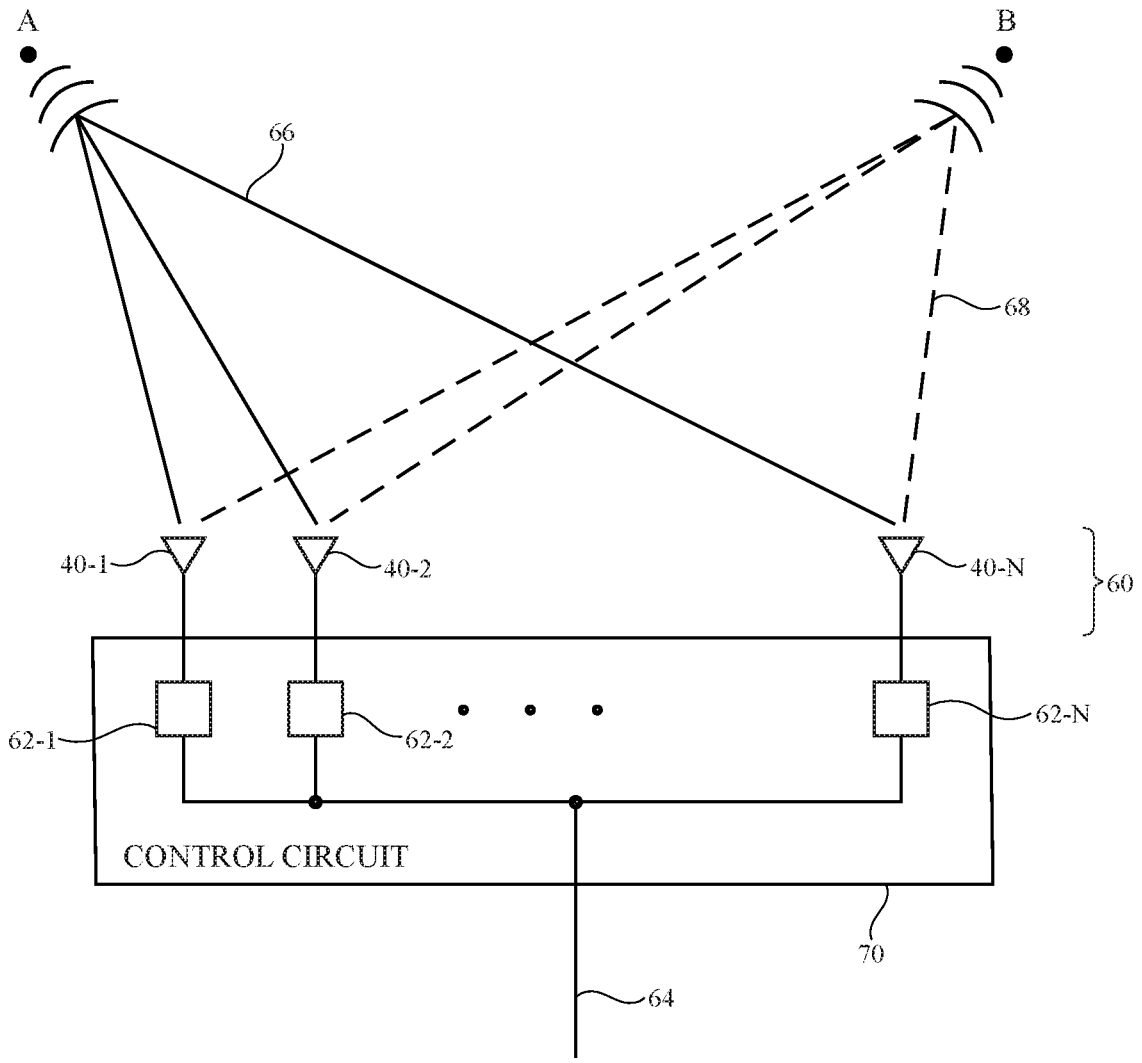
FIG. 4 is a diagram of an illustrative phased antenna array that may be adjusted using control circuitry to direct a beam of wireless wave signals in accordance with an embodiment.

FIG. 4 is a diagram showing how antennas 40 on device 10 may be formed in a phased antenna array. As shown in FIG. 4, an array 60 of antennas 40 may be coupled to a signal path such as path 64 (e.g., one or more radio-frequency transmission line structures, extremely high frequency waveguide structures or other extremely high frequency transmission line structures, etc.). Array 60 may include a number N of antennas 40 (e.g., a first antenna 40-1, a second antenna 40-2, an Nth antenna 40-N, etc.). Antennas 40 in phased antenna array 60 may be arranged in any desired number of rows and columns or in any other desired pattern (e.g., the antennas need not be arranged in a grid pattern having rows and columns). During signal transmission operations, path 64 may be used to supply signals (e.g., millimeter wave signals) from transceiver circuitry 28 to phased antenna array 60 for wireless transmission to external wireless equipment. During signal reception operations, path 64 may be used to convey signals received at phased antenna array 60 from external equipment to transceiver circuitry 28.

The use of multiple antennas 40 in array 60 allows beam steering arrangements to be implemented by controlling the relative phases and amplitudes of the signals for the antennas. In the example of FIG. 4, antennas 40 each have a corresponding phase and amplitude controller 62 (e.g., a first controller 62-1 coupled between signal path 64 and first antenna 40-1, a second controller 62-2 coupled between signal path 64 and second antenna 40-2, an Nth controller 62-N coupled between path 64 and Nth antenna 40-N, etc.).

Beam steering circuitry such as control circuitry 70 may use phase and amplitude controllers 62 to adjust the relative phases and amplitudes of the transmitted signals that are provided to each of the antennas in array 60 and to adjust the relative phases of the received signals that are received by array 60 from external equipment. The term "beam" or "signal beam" may be used herein to collectively refer to wireless signals that are transmitted and received by array 60 in a particular direction. The term "transmit beam" may sometimes be used herein to refer to wireless signals that are transmitted in a particular direction whereas the term "receive beam" may sometimes be used herein to refer to wireless signals that are received from a particular direction. In scenarios in which device 10 includes multiple phased antenna arrays, each phased antenna array may be steered using a respective beam steering circuit 70 (e.g., each phased antenna array may communicate using a respective beam that is steered using a corresponding set of phase and amplitude settings).

If, for example, control circuitry 70 is adjusted to produce a first set of phases and amplitudes on the transmitted signals (e.g., based on control signals received from control circuitry 14), the transmitted signals will form a transmit beam as shown by beam 66 of FIG. 4 that is oriented in the direction of point A. If, however, control circuitry 70 adjusts controllers 62 to produce a second set of phases and amplitudes on the transmitted signals, the transmitted signals will form a beam as shown by beam 68 that is oriented in the direction of point B. Similarly, if control circuitry 70 adjusts controllers 62 to produce the first set of phases and amplitudes, wireless signals (e.g., millimeter wave signals in a millimeter wave frequency beam) may be received from the direction of point A as shown by beam 66. If control circuitry 70 adjusts controllers 62 to produce the second set of phases and amplitudes, signals may be received from the direction of point B, as shown by beam 68. Control circuit 70 may be controlled by control circuitry 14 of FIG. 2 or by other control and processing circuitry in device 10 if desired.

When performing millimeter and centimeter wave communications, wireless signals are conveyed over a line of sight path between phased antenna array 60 and external equipment. If the external equipment is located at location A of FIG. 4, circuit 70 may be adjusted to steer the signal beam towards direction A. If the external equipment is located at location B, circuit 70 may be adjusted to steer the signal beam towards direction B. In the example of FIG. 4, beam steering is shown as being performed over a single degree of freedom for the sake of simplicity (e.g., towards the left and right on the page of FIG. 4). However, in practice, the beam is steered over two degrees of freedom (e.g., into and out of the page and to the left and right on the page of FIG. 4).

The radiation pattern of array 60 may depend on the particular arrangement of antennas 40 within the array. In scenarios where antennas 40 in array 60 are arranged in a rectangular grid of aligned rows and columns, the radiation pattern of the array may be excessively non-uniform (e.g., millimeter wave signals transmitted by the array may have a greater gain in certain directions than in others). If desired, antennas 40 may be arranged in array 60 so that array 60 exhibits a radiation pattern that is sufficiently uniform over all beam steering angles.

Figure 5A:
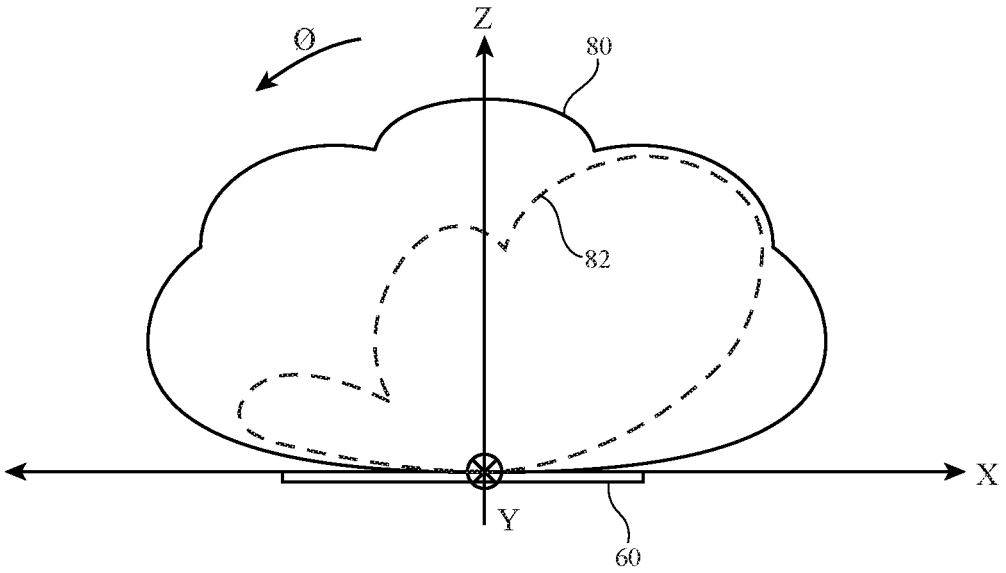
FIGS. 5A and 5B are diagrams showing a radiation pattern of an illustrative phased antenna array in accordance with an embodiment.

FIG. 5A is a side-view showing how antenna array 60 may exhibit a uniform radiation pattern. As shown in FIG. 5A, antenna array 60 may lie in the X-Y plane of FIG. 5A. Array 60 may transmit and receive millimeter wave signals or other wireless signals at frequencies between 10 GHz and 300 GHz in the positive Z-direction of FIG. 5A (e.g., in a hemisphere of possible coverage extending above the X-Y plane in the Z-direction). In scenarios where antennas 40 are arranged in a rectangular grid within a corresponding phased antenna array, the array may exhibit a radiation pattern such as a radiation pattern associated with pattern envelope 82. Pattern envelope (curve) 82 may be indicative of the gain of the wireless signals transmitted by the array when steered over the entire hemisphere of coverage for the array. The distance of curve 82 from the origin of FIG. 5A is indicative of the gain of the array at different beam steering angles. As shown by envelope 82, the array can exhibit greater gain in some directions than in others. This may cause the array to exhibit insufficient gain when steered in some directions. If array 60 is transmitting wireless signals to external equipment in those directions, errors may be introduced in the data received by the external equipment or the corresponding communications link may be dropped.

If desired, antennas 40 may be arranged in non-rectangular patterns that configure array 60 to exhibit a uniform radiation pattern such as a radiation pattern associated with pattern envelope 80 of FIG. 5A. As shown by pattern envelope 80, array 60 may exhibit a relatively uniform gain when steered over all possible elevation angles θ (e.g., over the entire hemisphere of coverage for the array). The example of FIG. 5A shows a cut of the three-dimensional pattern envelope for array 60 within the X-Z plane (e.g., the pattern envelope as array 60 is steered over different elevation angles θ).

Figure 5B:
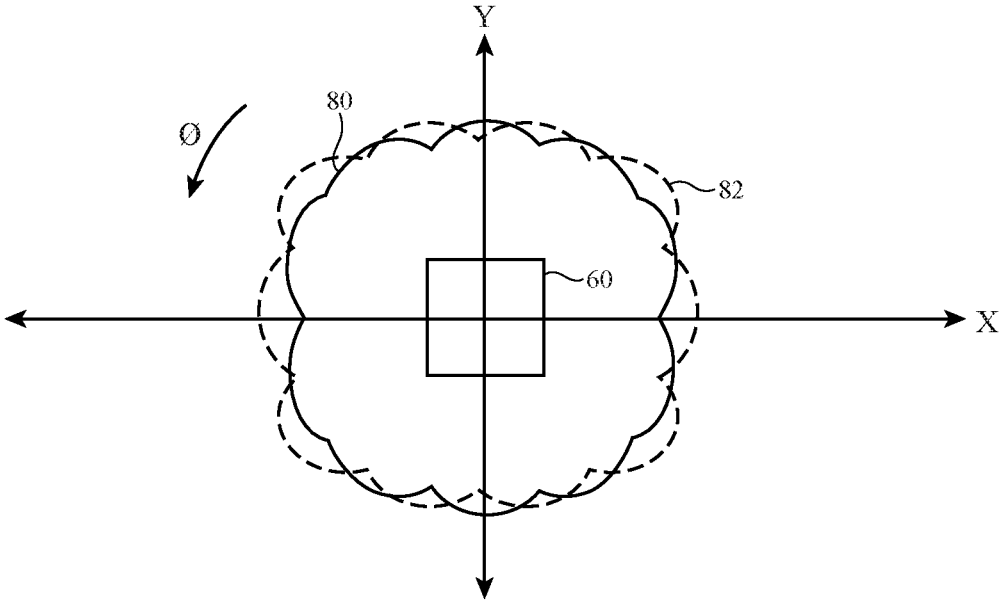

FIG. 5B is a top-down view showing how array 60 may exhibit a uniform radiation pattern envelope as array 60 is steered over different azimuthal angles φ (e.g., showing a cut of the three-dimensional pattern envelope within the X-Y plane as array 60 is steered over different azimuthal angles φ). As shown in FIG. 5B, pattern envelope 82 of a rectangular array may be associated with significantly higher gains at some azimuthal angles φ than at other azimuthal angles φ. Pattern envelope 80 associated with array 60 having antennas 40 arranged in non-rectangular patterns is more uniform (e.g., flatter or more smoothly curved) over all azimuthal angles φ. When configured in this way, array 60 may maintain a relatively high quality communications link with external equipment regardless of where the external equipment is located within the hemisphere of coverage of the array (e.g., regardless of the elevation angle θ or azimuthal angle φ to which the beam is steered).

Figure 6:
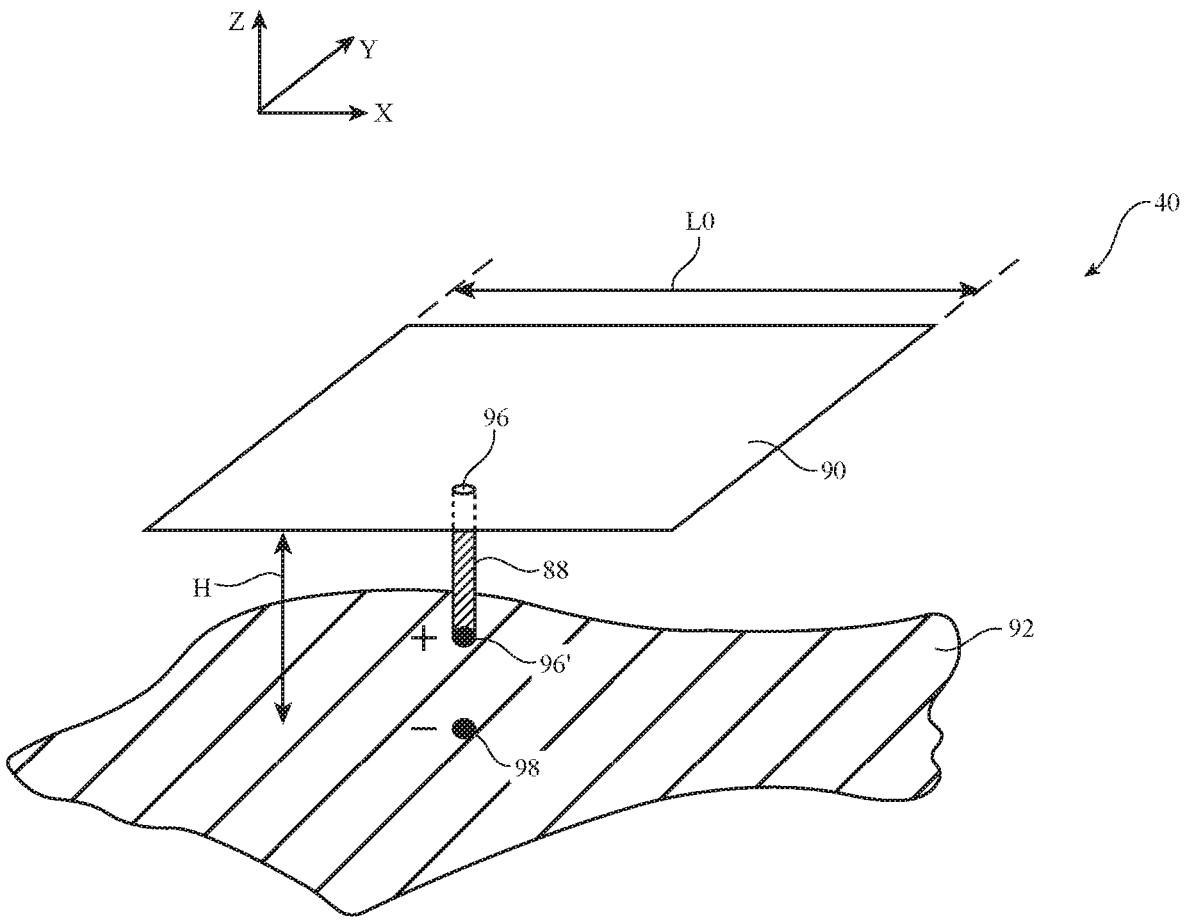
FIG. 6 is a perspective view of an illustrative patch antenna in accordance with an embodiment.

Antennas 40 in array 60 may be formed using any desired type of antennas (e.g., inverted-F antennas, dipole antennas, patch antennas, etc.). Patch antenna structures that may be used for implementing antennas 40 are shown in FIG. 6. As shown in FIG. 6, patch antenna 40 may have a patch antenna resonating element such as patch 90 that is separated from a ground plane structure such as ground 92. Antenna patch resonating element 90 and ground 92 may be formed from metal foil, machined metal structures, metal traces on a printed circuit or a molded plastic carrier, electronic device housing structures, or other conductive structures in an electronic device such as device 10.

Antenna 40 may be coupled to transceiver circuitry such as transceiver circuitry 20 of FIG. 2 using radio-frequency transmission line structures. As shown in FIG. 6, radio-frequency transmission line structures may be coupled to antenna feed structures associated with antenna 40. As an example, antenna 40 may have an antenna feed with a positive antenna feed terminal such as terminal 96 coupled to patch resonating element 90 and a ground antenna feed terminal such as ground antenna feed terminal 98 coupled to ground 92. A positive transmission line conductor in the radio-frequency transmission line structures may be coupled between transceiver circuitry 20 and positive antenna feed terminal 96. A ground transmission line conductor in the radio-frequency transmission line structures may be coupled between transceiver circuitry 20 and ground antenna feed terminal 98. If desired conductive path 94 may be used to couple terminal 96' to terminal 96 so that antenna 40 is fed using a transmission line with a positive conductor coupled to terminal 96' and thus terminal 96. If desired, conductive path 94 may be omitted. Other types of antenna feed arrangements may be used if desired. The illustrative feeding configuration of FIG. 6 is merely illustrative.

As shown in FIG. 6, antenna patch resonating element 90 may lie within a plane such as the X-Y plane of FIGS. 5 and 6. Ground 92 may line within a plane that is parallel to the plane of antenna patch resonating element (patch) 90. Patch 90 and ground 92 may therefore lie in separate parallel planes that are separated by a distance H. The length of the sides of patch resonating element 90 may be selected so that antenna 40 resonates at a desired operating frequency. For example, the sides of element 90 may each have a length L0 that is approximately equal to half of the wavelength (e.g., within 15% of half of the wavelength) of the signals conveyed by antenna 40 (e.g., in scenarios where patch element 90 is substantially square).

The example of FIG. 6 is merely illustrative. Patch 90 may have a square shape in which all of the sides of patch 90 are the same length or may have a rectangular shape. In general, patch 90 and ground 92 may have different shapes and orientations (e.g., planar shapes, curved patch shapes, patch element shapes with non-rectangular outlines, shapes with straight edges such as squares, shapes with curved edges such as ovals and circles, shapes with combinations of curved and straight edges, etc.). In scenarios where patch 90 is non-rectangular, patch 90 may have a side or a maximum lateral dimension that is approximately equal to (e.g., within 15% of) half of the wavelength of operation, for example.

Figure 7:
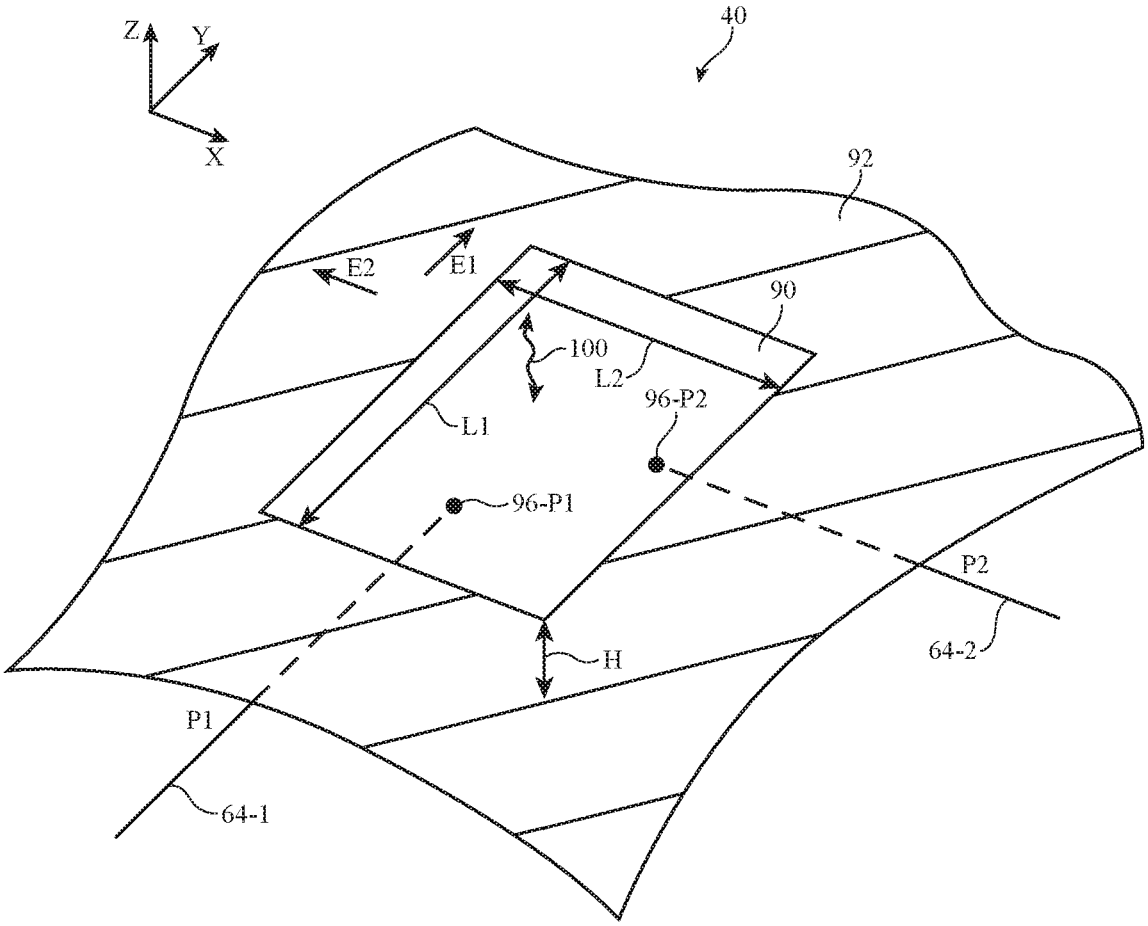
FIG. 7 is a perspective view of an illustrative patch antenna with dual ports in accordance with an embodiment.

To enhance the polarizations handled by patch antenna 40, antenna 40 may be provided with multiple feeds. An illustrative patch antenna with multiple feeds is shown in FIG. 7. As shown in FIG. 7, antenna 40 may have a first feed at antenna port P1 that is coupled to transmission line 64-1 and a second feed at antenna port P2 that is coupled to transmission line 64-2. The first antenna feed may have a first ground feed terminal coupled to ground 92 and a first positive feed terminal 96-P1 coupled to patch antenna resonating element 90. The second antenna feed may have a second ground feed terminal coupled to ground 92 and a second positive feed terminal 96-P2.

Patch 90 may have a rectangular shape with a first pair of edges running parallel to dimension Y and a second pair of perpendicular edges running parallel to dimension X. The length of patch 90 in dimension Y is L1 and the length of patch 90 in dimension X is L2. With this configuration, antenna 40 may be characterized by orthogonal polarizations.

When using the first antenna feed associated with port P1, antenna 40 may transmit and/or receive antenna signals in a first communications band at a first frequency (e.g., a frequency at which one-half of the corresponding wavelength is approximately equal to dimension L1). These signals may have a first polarization (e.g., the electric field E1 of antenna signals 100 associated with port P1 may be oriented parallel to dimension Y). When using the antenna feed associated with port P2, antenna 40 may transmit and/or receive antenna signals in a second communications band at a second frequency (e.g., a frequency at which one-half of the corresponding wavelength is approximately equal to dimension L2). These signals may have a second polarization (e.g., the electric field E2 of antenna signals 100 associated with port P2 may be oriented parallel to dimension X so that the polarizations associated with ports P1 and P2 are orthogonal to each other). In scenarios where patch 90 is square (e.g., length L1 is equal to length L2), ports P1 and P2 may cover the same communications band. In scenarios where patch 90 is rectangular, ports P1 and P2 may cover different communications bands if desired. During wireless communications using device 10, device 10 may use port P1, port P2, or both port P1 and P2 to transmit and/or receive signals (e.g., millimeter wave and centimeter wave signals).

The example of FIG. 7 is merely illustrative. Patch 90 may have a square shape in which all of the sides of patch 90 are the same length or may have a rectangular shape in which length L1 is different from length L2. In general, patch 90 and ground 92 may have different shapes and orientations (e.g., planar shapes, curved patch shapes, patch element shapes with non-rectangular outlines, shapes with straight edges such as squares, shapes with curved edges such as ovals and circles, shapes with combinations of curved and straight edges, etc.). In scenarios where patch 90 is non-rectangular, patch 90 may have a side or a maximum lateral dimension (e.g., a longest side) that is approximately equal to (e.g., within 15% of) half of the wavelength of operation, for example.

Antennas 40 such as single-polarization patch antennas of the type shown in FIG. 6 and/or dual-polarization patch antennas of the type shown in FIG. 7 may be arranged within a corresponding phased antenna array 60 in device 10. In general, it may be desirable for phased antenna array 60 to be able to provide coverage in multiple communications bands (e.g., bands between 10 GHz and 300 GHz) with a relatively uniform radiation pattern over all angles within the coverage area of array 60. In one suitable arrangement, array 60 may provide coverage in a first communications band, a second communications band that includes higher frequencies than the first communications band, and/or a third millimeter band that includes higher frequencies than the second communications band. As examples, the first communications band (sometimes referred to herein as a low band or centimeter wave low band) may include frequencies from 27.5 GHz to 28.5 GHz, from 26 GHz to 30 GHz, from 20 to 36 GHz, or any other desired frequencies between 10 GHz and 300 GHz. The second communications band (sometimes referred to herein as a midband or millimeter wave midband) may include frequencies from 37 GHz to 41 GHz, from 36 GHz to 42 GHz, from 30 GHz to 56 GHz, or any other desired frequencies between 10 GHz and 300 GHz that are greater than the low band. The third communications band (sometimes referred to herein as a high band or millimeter wave high band) may include frequencies from 57 GHz to 71 GHz, from 58 GHz to 63 GHz, from 59 GHz to 61 GHz, from 42 GHz to 71 GHz, or any other desired frequencies between 10 GHz and 300 GHz that are greater than the midband. As one example, the low band and midband may include $5^{th}$ generation mobile networks or $5^{th}$ generation wireless systems (5G) communications bands whereas the high band includes IEEE 802.11ad communications bands. These examples are merely illustrative.

Figure 8:
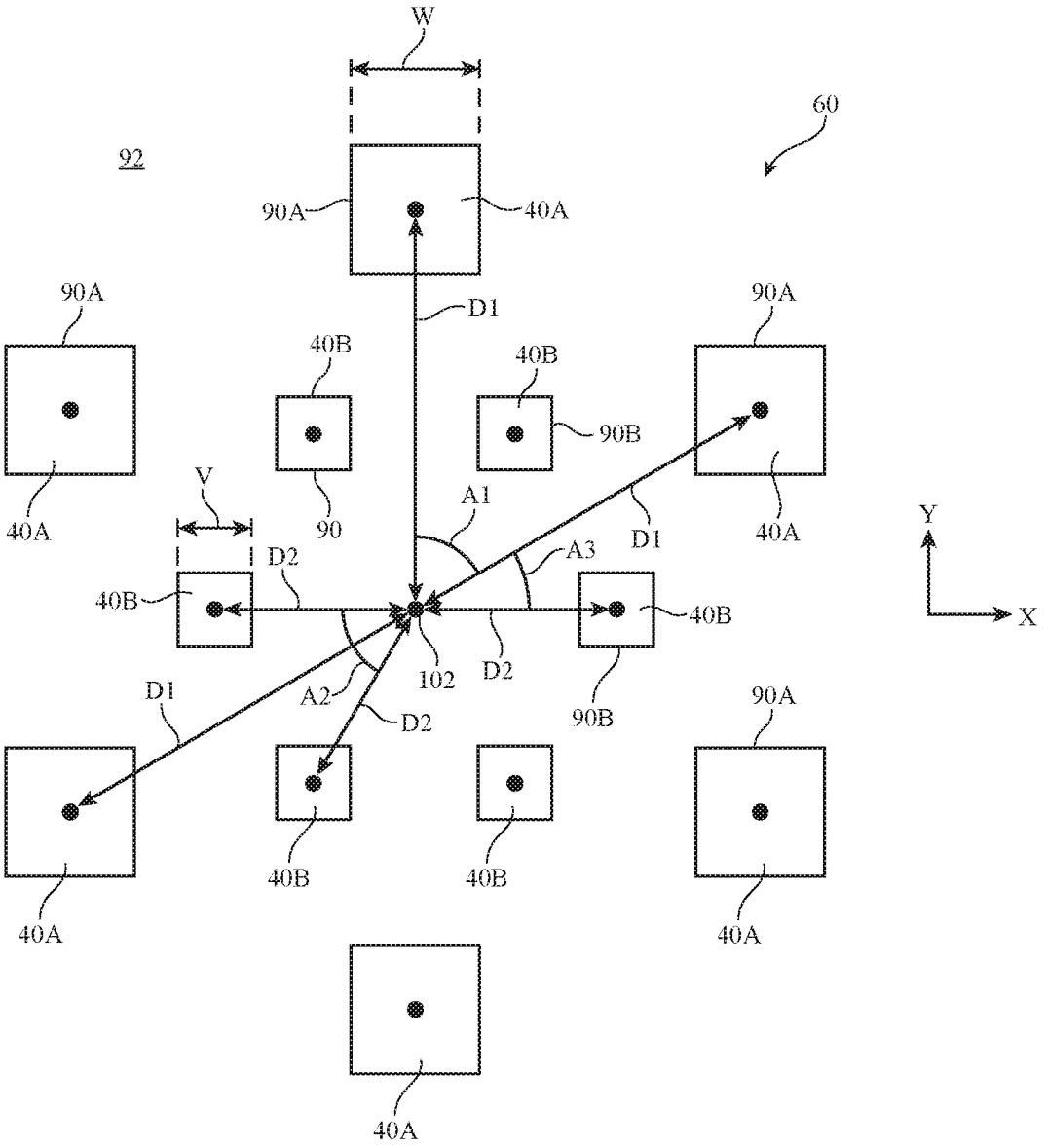
FIG. 8 is a top-down view of an illustrative phased antenna array having concentric rings of antennas in accordance with an embodiment.

In order to provide coverage in multiple communications bands above 10 GHz, different antennas 40 having patch elements 90 of different sizes may be incorporated into the same phased antenna array 60. FIG. 8 is a top-down view of phased antenna array 60 showing how array 60 may be configured to perform multi-band millimeter and centimeter wave communications with a uniform radiation pattern. As shown in FIG. 8, phased antenna array 60 may include multiple sets of antennas 40 (e.g., a first set of antennas 40A and a second set of antennas 40B). Each antenna in the set of antennas 40A (sometimes referred to herein as a group, sub-array, or ring of antennas 40A) may be the same type of antenna having the same dimensions/shape (e.g., for covering the same frequencies). Similarly, each antenna in the second set of antennas 40B (sometimes referred to herein as a group, sub-array, or ring of antennas 40B) may be the same type of antenna having the same dimensions for covering the same frequencies.

As an example, each of antennas 40A may be a single-polarization patch antenna of the type shown in FIG. 6 or a dual-polarization patch antenna of the type shown in FIG. 7. Similarly, each of antennas 40B may be a single-polarization patch antenna of the type shown in FIG. 6 or a dual-polarization patch antenna of the type shown in FIG. 7. Each of antennas 40A may include a corresponding patch antenna resonating element 90 such as patch antenna resonating element 90A. Each of antennas 40B may include a corresponding patch antenna resonating element 90 such as patch antenna resonating element 90B. In one suitable arrangement, each of antennas 40A and 40B may include separate ground plane structures. In another suitable arrangement, each of antennas 40A and 40B may be formed using the same (common) antenna ground plane 92. Patch elements 90A and 90B may be separated from ground plane 92 by a dielectric substrate, for example.

In order to provide coverage in multiple communications bands between 10 GHz and 300 GHz, each of antennas 40A may provide coverage in a first communications band between 10 GHz and 300 GHz whereas each of antennas 40B provides coverage in a second communications band between 10 GHz and 300 GHz. In the example of FIG. 8, antennas 40B provide coverage in a millimeter wave communications band at higher frequencies than antennas 40A. This is merely illustrative. If desired, antennas 40B may provide coverage in a communications band at lower frequencies than antennas 40A.

Patch antenna resonating elements 90B of antennas 40B may have sides of length V (e.g., a length V such as length L0 of FIG. 6, length L1 or L2 of FIG. 7, a maximum lateral dimension V, etc.). Patch antenna resonating elements 90A of antennas 40A may have sides of length W (e.g., a length W such as length L0 of FIG. 6, length L1 or L2 of FIG. 7, a maximum lateral dimension W, etc.). Because antennas 40B are used to cover higher frequencies than antennas 40A in the example of FIG. 8, dimension W may be greater than dimension V. As an example, dimension W may be approximately equal to twice length V (e.g., dimension W may be between 1.7 and 2.3 times length V, between 1.8 and 2.2 times length V, twice length V, etc.).

The length of sides W of elements 90A may be approximately equal to half of the wavelength of operation of antennas 40A and the lengths of sides V of elements 90B may be approximately equal to half of the wavelength of operation of antennas 40B in free space (i.e., in the absence of a dielectric substrate between ground plane 92 and elements 90). In practice, the lengths of sides W and V may be less than half of the corresponding wavelengths of operation by an offset that is dependent upon the dielectric constant of the substrate between ground plane 92 and elements 90. As an example, in the absence of a dielectric substrate between ground plane 92 and elements 90, when array 60 is configured to cover a first communications band from 27.5 GHz to 28.5 GHz and a second communications band from 57 GHz to 71 GHz, dimension W may be approximately equal to (e.g., within 15% of) 2.0-2.5 mm for covering the first communications band, whereas dimension V is approximately equal to 1.0-1.25 mm for covering the second communications band. In scenarios where a dielectric substrate having a dielectric constant of 3.0-3.5 is formed between ground plane 92 and elements 90, dimension W may be approximately equal to 1.1-1.2 mm and dimension V may be approximately equal to 0.5-0.6 mm, for example.

In the example of FIG. 8, antenna resonating elements 90A and 90B are square, the sides of each element 90A are parallel to corresponding sides of the other elements 90A, the sides of each element 90B are parallel to corresponding sides of the other elements 90B, and the sides of each element 90A are parallel to corresponding sides on each of elements 90B. This is merely illustrative and, in other arrangements, antennas 40A and 40B may include patch antenna resonating elements 90 having any desired shapes and orientations (e.g., planar shapes, curved patch shapes, patch element shapes with non-rectangular outlines, shapes with straight edges such as squares, shapes with curved edges such as ovals having major axes with lengths W or V and circles having diameters with lengths W or V, shapes with combinations of curved and straight edges, polygonal shapes having side lengths of W or V or maximum lateral dimensions W or V, etc.). The sides of elements 90A need not be parallel to corresponding sides on the other elements 90A and the sides of elements 90B need not be parallel to corresponding sides on the other elements 90B, if desired. Similarly, the sides of elements 90A need not be parallel to corresponding sides on elements 90B, if desired.

In some scenarios, multiple separate phased antenna arrays are formed for covering different communications bands (i.e., antennas 40A are formed in a separate array from antennas 40B). However, separate phased antenna arrays may occupy an excessive amount of the limited space within device 10. In order to reduce the amount of space required within device 10, antennas 40A and 40B may be co-located within the same phased antenna array 60 (e.g., antennas 40A and 40B in array 60 may both combine to generate a single beam of wireless signals that is steered in a particular direction).

In some scenarios, antennas 40A and 40B are both arranged in a rectangular grid pattern within a single array. However, patterning antennas 40A and 40B in a rectangular grid pattern may cause the array to exhibit a non-uniform radiation pattern such that beam steering in some azimuthal directions results in a significantly higher gain than beam steering in other azimuthal directions (i.e., such that the array exhibits a radiation pattern such as a pattern associated with envelope 82 of FIG. 5B). In order to provide array 60 with a uniform antenna pattern envelope as the beam is steered over different azimuthal angles φ (e.g., as shown by pattern envelope 80 of FIG. 5B), antennas 40A and 40B may be arranged in a symmetric and non-rectangular pattern such as a pattern of one or more concentric rings.

As shown in FIG. 8, antennas 40A and 40B may be arranged within array 60 in a pattern of two concentric rings that are centered about a central axis such as axis 102 (sometimes referred to herein as center 102, central point 102, or center point 102). The first set of antennas 40A may be arranged in a first ring around center axis 102 whereas the second set of antennas 40B is arranged in a second ring around center axis 102. The ring of antennas 40A may surround the ring of antennas 40B in array 60 (e.g., each antenna 40B may be located closer to center point 102 than antennas 40A). The ring of antennas 40A may sometimes be referred to herein as an outer ring of antennas whereas the ring of antennas 40B is sometimes referred to herein as an inner ring of antennas.

Each antenna 40A in the outer ring may be located at a first distance D1 with respect to center axis 102. Each antenna 40B in the inner ring may be located at a second distance D2 with respect to center axis 102. Second distance D2 may be less than first distance D1. In order to optimize uniformity of the radiation pattern exhibited by array 60, distance D1 may approximately equal to the wavelength of operation of antennas 40A (e.g., approximately equal to twice dimension W) whereas distance D2 is approximately equal to the wavelength of operation of antennas 40B (e.g., approximately equal to twice dimension V).

In the scenario where no dielectric substrate is formed between ground plane 92 and elements 90, antennas 40A cover a first band from 27.5 GHz to 28.5 GHz, and antennas 40B cover a second band from 57 GHz to 71 GHz, distance D1 may be approximately equal to (e.g., within 15% of, within 10% of, etc.) 2.0-2.5 mm whereas distance D2 is approximately equal to 1.0-1.25 mm (e.g., distance D1 may be approximately twice distance D2 because the wavelength of operation of antennas 40A and corresponding dimension W is approximately twice the wavelength of operation of antennas 40B and corresponding dimension V, respectively). In scenarios where a dielectric substrate having a dielectric constant between 3.0 and 3.5 is formed between ground plane 92 and elements 90, distance D1 may be approximately equal to 1.1-1.2 mm and distance D2 may be approximately equal to 0.5-0.6 mm, for example.

Array 60 may include a number N of antennas 40A and a number M of antennas 40B. In the example of FIG. 8, array 60 includes a total of twelve antennas 40 (e.g., six antennas 40A and six antennas 40B) arranged in two concentric hexagonal rings. Array 60 may include any desired number of antennas (e.g., sixteen antennas, fourteen antennas, between ten and fourteen antennas, between six and ten antennas, twenty-four antennas, between sixteen and twenty-four antennas, more than twenty-four antennas, etc.). In general, a greater number of antennas 40 may increase the overall gain of array 60 (but also the overall manufacturing and operating complexity of array 60) relative to scenarios where fewer antennas 40 are formed. The number N of antennas 40A may be equal to the number M of antennas 40B in array 60 or there may be more or fewer antennas 40A than antennas 40B in array 60 (e.g., N may be equal to, less than, or greater than M).

In order to further optimize the uniformity of the radiation pattern exhibited by array 60, antennas 40A and antennas 40B may each be symmetrically (uniformly) arranged around center axis 102. As shown in FIG. 8, each antenna 40A in the outer ring may be angularly separated from the two adjacent antennas 40A in the outer ring by angular separation A1 about center axis 102. Similarly, each antenna 40B in the inner ring is angularly separated from the two adjacent antennas 40B in the inner ring by angular separation A2 about center axis A1. Each antenna 40A may be separated from an opposing antenna 40A in the outer ring by twice distance D1 whereas each antenna 40B is separated from an opposing antenna 40B in the inner ring by twice distance D2.

Because antennas 40A and 40B are uniformly distributed across the outer ring and around point 102, angle A1 may be equal to 360 degrees divided by the number N of antennas 40A in array 60, whereas angle A2 is equal to 360 degrees divided by the number M of antennas 40B in array 60. In scenarios where the number N of antennas 40A equals the number M of antennas 40B, angle A1 is equal to angle A2. In the example of FIG. 8 (where N and M are both equal to six), angle A1 and angle A2 are both equal to 60 degrees. This example is merely illustrative. If desired, antennas 40A and/or antennas 40B may be non-uniformly distributed about axis 102. If desired, some antennas 40A may be more closely grouped together about axis 102 than other antennas 40A and/or some antennas 40B may be more closely grouped together about axis 102 than other antennas 40B.

If desired, antennas 40B may be angularly offset with respect to antennas 40A about axis 102. As shown in FIG. 8, antennas 40B are placed at locations that are offset by angle A3 about axis 102 with respect to the locations of antennas 40A (e.g., a radial line drawn from point 102 to a given antenna 40A is angularly offset from a radial line drawn from point 102 to an adjacent antenna 40B by angle A3 about point 102). As an example, angle A3 may be approximately equal to half of angle A1 and A2 (e.g., each antennas 40B in the inner ring is angularly located approximately half way between adjacent antennas 40A in the outer ring about point 102). In the example of FIG. 8, angle A3 is approximately equal to 30 degrees (i.e., half of angle A2 and angle A1). This is merely illustrative and, in general, angle A3 may be equal to any desired value between 0 degrees (e.g., in scenarios where antennas 40A are each aligned with a corresponding antenna 40B about point 102) and angle A1 (e.g., between 20 and 40 degrees, between 25 and 35 degrees, etc.).

In other words, antennas 40A in the outer ring may be located at a first set of angles around point 102 (e.g., at 0 degrees, 60 degrees, 120 degrees, 180 degrees, 240 degrees, and 300 degrees with respect to the Y-axis of FIG. 8), where each angle in the first set is separated from the next and previous angles in the first set by angle A1. Similarly, antenna 40B in the inner ring may be located at a second set of angles around point 102 (e.g., at 30 degrees, 90 degrees, 150 degrees, 210 degrees, 270, and 330 degrees with respect to the Y-axis), where each angle in the second set is separated from the next and previous angles in the second set by angle A2. The first set of angles may be offset with respect to the second set of angles by offset A3.

In the example of FIG. 8, the center of each antenna 40A (e.g., the center of patch 90A) is shown as being located at distance D1 from center axis 102 and at angle A1 about axis 102 from the center of the adjacent antennas 40A. Similarly, the center of each antenna 40B (e.g., patch 90B) is shown as being located at distance D2 from center axis 102 and at angle A2 about axis 102 from the center of the adjacent antennas 40B. This is merely illustrative. In general, any desired point within the outline or on the edges of patches 90A may be located at distance D1 from center axis 102 and at angle A1 about axis 102 from any desired point within the outline or on the edges of patch 90A in the adjacent antennas 40A. Similarly, any desired point within the outline or on the edges of patch 90B on each antenna 40B may be located at distance D2 from center axis 102 and at angle A2 about axis 102 from any desired point within the outline or on the edges of patch 90B in the adjacent antennas 40B. In one suitable arrangement (e.g., as shown in FIG. 8), antennas 40B are arranged in a circular ring in which antennas 40B are located at distance D2 from point 102 and antennas 40A are arranged in a circular ring in which antennas 40A are located at distance D1 from point 102. In this arrangement, D1 and D2 may be selected in such a way that each of the antennas 40A are located at approximately half of the wavelength of operation of antennas 40A from the two adjacent antennas 40A in the outer ring and that each of the antennas 40B are located at approximately half of the wavelength of operation of antennas 40B from the two adjacent antennas 40B in the inner ring.

The example of FIG. 8 in which the outer ring of antennas 40A and the inner ring of antennas 40B are both circular is merely illustrative. If desired, the outer ring of antennas 40A and/or the inner ring of antennas 40B may be arranged in elliptical or other polygonal ring shapes. If desired, two or more antennas 40A may be located at different distances from center axis 102. Two or more antennas 40B may be located at different distances from center axis 102 if desired.

When arranged in this manner, phased antenna array 60 may cover two different communications bands between 10 GHz and 300 GHz while exhibiting a uniform radiation pattern such as radiation pattern 80 of FIGS. 5A and 5B. This may allow beam steering circuitry 70 (FIG. 4) to steer the beam of wireless signals for array 60 within one or both of the two communications bands between 10 GHz and 300 GHz and in any desired direction with a relatively constant gain (e.g., within 10% regardless of the direction of the beam). By co-locating lower frequency antennas 40A and higher frequency antennas 40B within the same phased antenna array 60, the antennas may occupy as much as half the space within device 10 relative to scenarios where antennas 40A and 40B are formed in separate arrays.

In some scenarios, it may be desirable to be able to cover a third communications band between 10 GHz and 300 GHz using array 60 such as a millimeter wave band from 37 GHz to 41 GHz. However, in practice, antennas 40A in the outer ring may not have sufficient bandwidth for covering both a first communications band (e.g., a first communications band from 27.5 GHz to 28.5 GHz) and the third communications band from 37 GHz to 41 GHz. If desired, array 60 may include a third set of antennas 40C for covering the third communications band.

Figure 9:
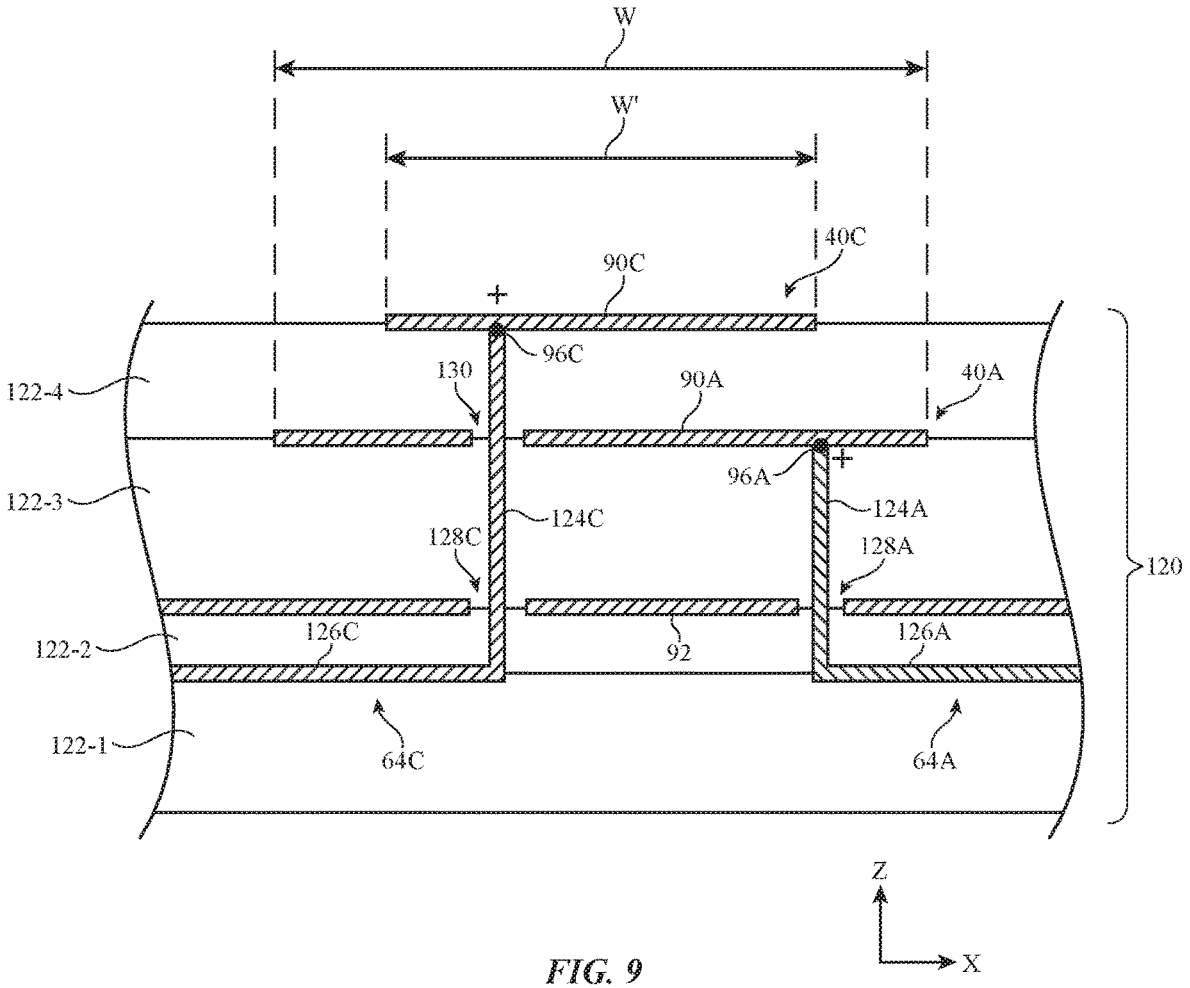
FIG. 9 is a cross-sectional side view of illustrative co-located patch antennas in accordance with an embodiment.

FIG. 9 is a cross-sectional side view of phased antenna array 60 showing how a third set of antennas 40C may be formed in array 60 for covering the third communications band. As shown in FIG. 9, phased antenna array 60 may be formed on a dielectric substrate such as substrate 120. Substrate 120 may be, for example, a rigid or printed circuit board or other dielectric substrate. Substrate 120 may include multiple dielectric layers 122 (e.g., multiple layers of printed circuit board substrate such as multiple layers of fiberglass-filled epoxy) such as a first dielectric layer 122-1, a second dielectric layer 122-2 over the first dielectric layer, a third dielectric layer 122-3 over the second dielectric layer, and a fourth dielectric layer 122-4 over the third dielectric layer. Additional dielectric layers 122 may be stacked within substrate 120 if desired.

With this type of arrangement, antenna 40A may be embedded within the layers of substrate 120. For example, ground plane 92 may be formed on a surface of second layer 122-2 whereas patch 90A of antenna 40A is formed on a surface of third layer 122-3. Antenna 40A may be fed using a first transmission line 64A and a first antenna feed having positive antenna feed terminal 96A coupled to patch 90A and a ground antenna feed terminal coupled to ground plane 92. First transmission line 64A may, for example, be formed from a conductive trace such as conductive trace 126A on a surface of first layer 122-1 and portions of ground layer 92. Conductive trace 126A may form the positive signal conductor for transmission line 64A, for example. A first hole or opening 128A may be formed in ground layer 92. First transmission line 64A may include a vertical conductor 124A (e.g., a conductive through-via) that extends from trace 126A through layer 122-2, opening 128A in ground layer 92, and layer 122-3 to antenna feed terminal 96A on patch element 90A. This example is merely illustrative and, if desired, other transmission line structures may be used (e.g., coaxial cable structures, stripline transmission line structures, etc.).

As shown in FIG. 9, dielectric layer 122-4 may be formed over patch 90A. An additional patch antenna such as patch antenna 40C may be formed using patch antenna resonating element 90C and ground layer 92. Patch antenna resonating element 90C may be formed from a conductive trace patterned onto a surface of layer 122-4. Antenna 40C may be fed using a second transmission line 64C and a second antenna feed having a positive antenna feed terminal 96C coupled to patch 90C and a ground antenna feed terminal coupled to ground 92. Second transmission line 64C may, for example, be formed from a conductive trace such as conductive trace 126C on the surface of first layer 122-1 and portions of ground layer 92. A second hole or opening 128C may be formed in ground layer 92. A hole or opening 130 may be formed in patch 90A. Second transmission line 64C may include a vertical conductor 124C (e.g., a conductive through-via) that extends from trace 126C through layer 122-2, opening 128C, layer 122-3, opening 130, and layer 122-4 to antenna feed terminal 96C on patch element 90C. This example is merely illustrative and, if desired, other transmission line structures may be used (e.g., coaxial cable structures, stripline transmission line structures, etc.).

Patch element 90C may have a width W'. As examples, patch element 90C may be a rectangular patch (e.g., as shown in FIGS. 6 and 7) having a side of length W', a square patch having sides of length W', a circular patch having diameter W', an elliptical patch having a major axis length W', or may have any other desired shape (e.g., where length W' is the maximum lateral dimension of the patch). Dimension W' of patch element 90C may be less than dimension W of patches 90A and greater than dimension V of patches 90B. This may allow antenna 40A to transmit and receive wireless signals at frequencies between 10 GHz and 300 GHz with external equipment without being blocked by element 90', for example.

The size of dimension W' may be selected so that antenna 40C resonates at a desired operating frequency. For example, dimension W' may be approximately equal to half of the wavelength (e.g., within 15% of half of the wavelength) of the signals conveyed by antenna 40C or less than this by a factor determined by the dielectric constant of substrate 122. In the scenario where antennas 40A cover a first frequency band from 27.5 GHz to 28.5 GHz, antennas 40B cover a millimeter wave frequency band from 57 GHz to 71 GHz, and antennas 40C cover a millimeter wave frequency band from 37 GHz to 41 GHz, dimension W' may be between 0.6 mm and 2.0 mm, for example.

In the example of FIG. 9, antennas 40A and 40C are shown as having only a single polarization (feed). If desired, antennas 40A and/or 40C may be dual-polarized patch antennas having two feeds (e.g., as shown in FIG. 7). In this scenario, additional holes may be formed in ground layer 92 and/or patch 90A to accommodate the additional feeds.

Antennas 40C for covering the third frequency band (e.g., from 37 GHz to 41 GHz) may be distributed throughout array 60 in any desired fashion. For example, antennas 40C may be formed over one, some, or all of antennas 40A in array 60 (FIG. 8). Co-locating antennas 40C with antennas 40A may reduce the overall space required within device 10 relative to scenarios where antennas 40C are formed within a separate phased antenna array. One or more antennas 40C may be formed separately from antennas 40A if desired (e.g., a third ring of antennas 40C may be formed in array 60 between the ring of antennas 40A and the ring of antennas 40B or antennas 40C may be formed at any other desired locations within array 60).

The example of FIG. 9 is merely illustrative. If desired, additional layers 122 may be interposed between trace 126C and ground 92, between ground 92 and patch 90A, and/or between patch 90A and patch 90C. In another suitable arrangement, substrate 120 is formed from a single dielectric layer (e.g., antennas 40A and 40C may be embedded within a single dielectric layer such as a molded plastic layer). In yet another suitable arrangement, substrate 120 may be omitted and antennas 40A and 40C may be formed on other substrate structures or may be formed without substrates.

In practice, antennas 40B may have insufficient bandwidth for covering an entirety of the millimeter wave communications band from 57 GHz to 71 GHz. If desired, antennas 40B may include parasitic antenna resonating elements that serve to broaden the bandwidth of antennas 40B.

Figure 10:
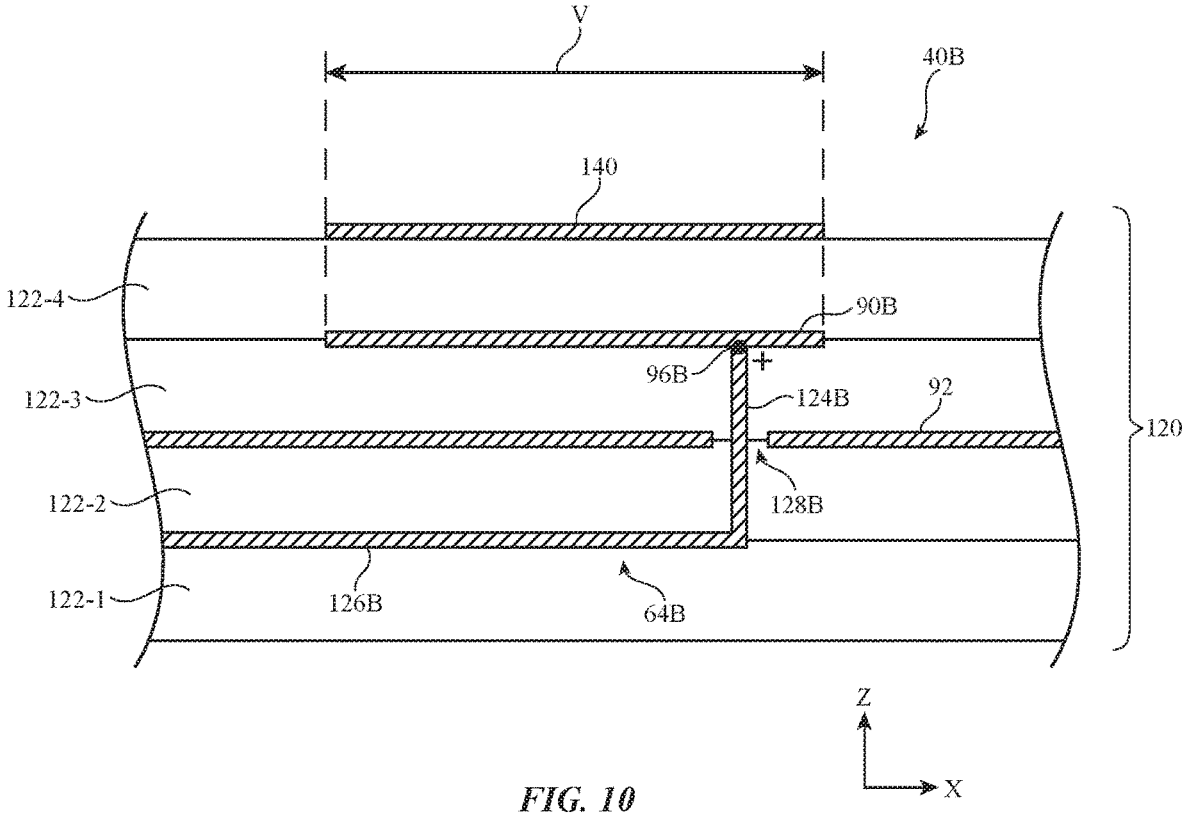
FIG. 10 is a cross-sectional side view of an illustrative patch antenna having a parasitic antenna resonating element in accordance with an embodiment.

FIG. 10 is a cross-sectional side view of phased antenna array 60 showing how antennas 40B may be provided with parasitic antenna resonating elements. As shown in FIG. 10, antenna 40B may be embedded within the layers of substrate 120. For example, ground plane 92 may be formed on a surface of second layer 122-2 whereas patch 90B of antenna 40B is formed on a surface of third layer 122-3. Antenna 40B may be fed using a transmission line 64B and an antenna feed that includes positive antenna feed terminal 96B coupled to patch 90B and a ground antenna feed terminal coupled to ground plane 92. Transmission line 64B may, for example, be formed from a conductive trace such as conductive trace 126B on a surface of first layer 122-1 and portions of ground layer 92. Conductive trace 126B may form the positive signal conductor for transmission line 64B, for example. A hole or opening 128B may be formed in ground layer 92. Transmission line 64B may include a vertical conductor 124B (e.g., a conductive through-via) that extends from trace 126B through layer 122-2, opening 128B in ground layer 92, and 122-3 to feed terminal 96B on patch element 90B. This example is merely illustrative and, if desired, other transmission line structures may be used (e.g., coaxial cable structures, stripline transmission line structures, etc.).

As shown in FIG. 10, dielectric layer 122-4 may be formed over patch 90B. A parasitic antenna resonating element such as element 140 may be formed from conductive traces on a surface of layer 122-4. Parasitic antenna resonating element 140 may sometimes be referred to herein as parasitic resonating element 140, parasitic antenna element 140, parasitic element 140, parasitic patch 140, parasitic conductor 140, parasitic structure 140, or patch 140. Parasitic element 140 is not directly fed, whereas patch antenna resonating element 90B is directly fed via transmission line 64B and feed terminal 96B. Parasitic element 140 may create a constructive perturbation of the electromagnetic field generated by patch antenna resonating element 90B, creating a new resonance for antenna 40B. This may serve to broaden the overall bandwidth of antenna 40B (e.g., to cover the entire millimeter wave frequency band from 57 GHz to 71 GHz).

Parasitic element 140 may have the same width V as patch 90B. As examples, parasitic element 140 may be a rectangular patch having a side of length V, a square patch having sides of length V, a cross-shaped patch having a maximum lateral dimension V, a circular patch having diameter V, an elliptical patch having a major axis of length V, or may have any other desired shape (e.g., where length V is the maximum lateral dimension of the parasitic element).

Parasitic elements 140 may be formed over one, some, or all of antennas 40B in array 60 (FIG. 8) to broaden the bandwidth of the corresponding antennas 40B and thus array 60. The example of FIG. 10 is merely illustrative. If desired, additional layers 122 may be interposed between trace 126B and ground 92, between ground 92 and patch 90B, and/or between patch 90B and parasitic element 140. In the example of FIG. 10, antenna 40B is shown as having only a single polarization (feed). If desired, antenna 40B may be a dual-polarized patch antenna having two feeds (e.g., as shown in FIG. 7).

Figure 11:
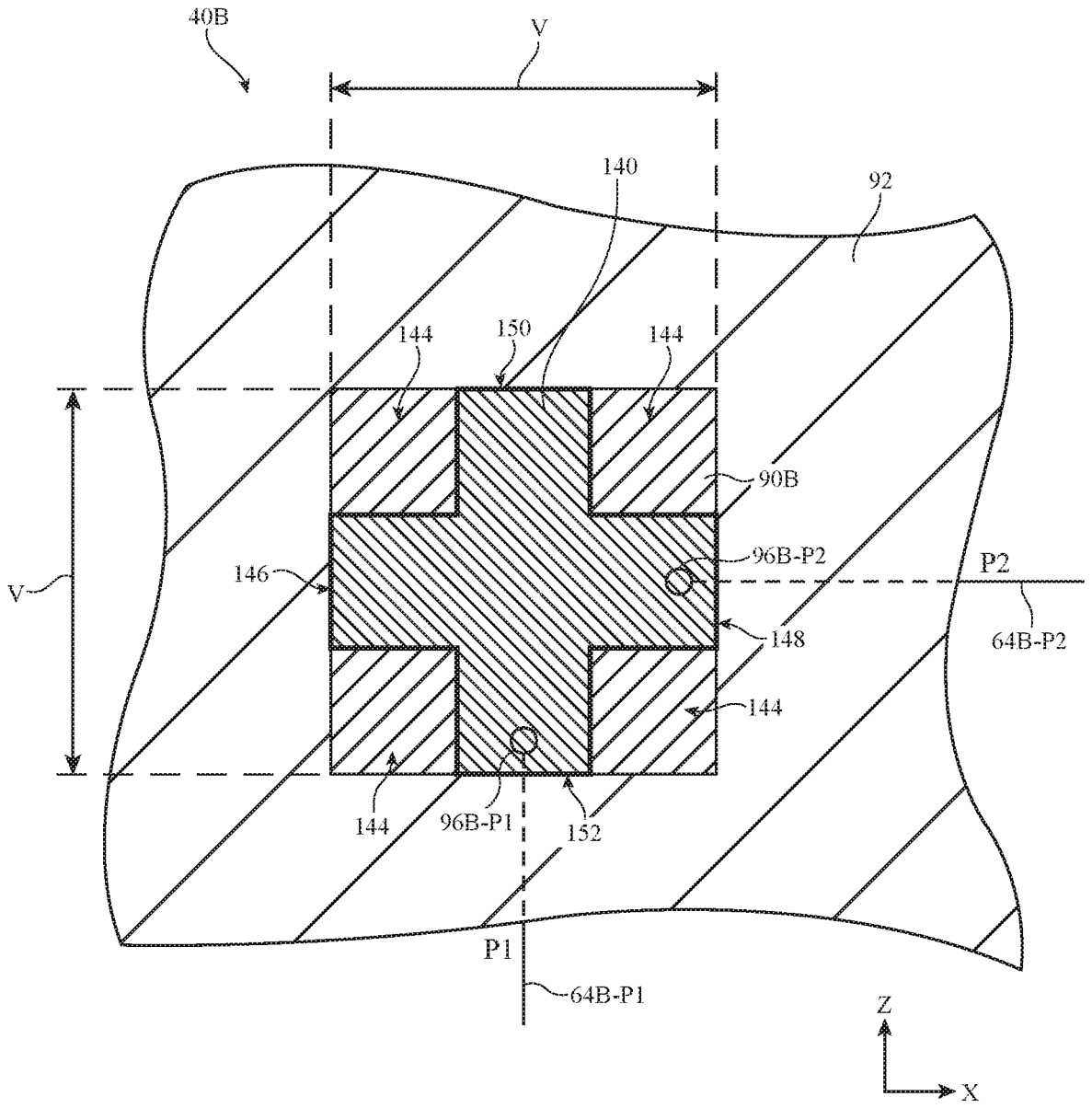
FIG. 11 is a top-down view of an illustrative patch antenna of the type shown in FIG. 10 in accordance with an embodiment.

FIG. 11 is a top-down view of antenna 40B having parasitic antenna resonating element 140 and two feeds for covering two orthogonal polarizations. As shown in FIG. 10, antenna 40B may have a first feed at antenna port P1 that is coupled to a first transmission line 64B-P1 and a second feed at antenna port P2 that is coupled to a second transmission line 64B-P2. The first antenna feed may have a first ground feed terminal coupled to ground 92 and a first positive feed terminal 96B-P1 coupled to patch antenna resonating element 90B at a first location. The second antenna feed may have a second ground feed terminal coupled to ground 92 and a second positive feed terminal 96B-P2 coupled to patch antenna resonating element 90B at a second location.

Parasitic resonating element 140 may be formed over patch 90B. At least some or an entirety of parasitic resonating element 140 may overlap patch 90B. In the example of FIG. 11, parasitic resonating element 140 has the same width V as patch 90B. If desired, parasitic element 140 may have a width that is less than width V. If desired, parasitic resonating element 140 may have a cross or "X" shape. As shown in FIG. 11, notches or slots 144 may be formed in patch 140 (e.g., by removing conductive material from the corners of a square patch having width V) to create a cross-shaped (X-shaped) parasitic resonating element 140. Cross-shaped parasitic resonating element 140 may include a first arm 150 that opposes a second arm 152 and a third arm 146 that opposes a fourth arm 148 (e.g., the distance from the end of arm 146 to the end of arm 148 and the distance from the end of arm 150 to the end of arm 152 may each be approximately equal to dimension V). Arm 146 may extend in parallel with arm 148 from opposing sides of the center of patch 140. Arm 150 may extend in parallel with arm 152 from opposing sides of the center of patch 140. In the example of FIG. 11, arms 146 and 148 each extend perpendicular to arms 150 and 152.

In a single-polarization patch antenna, the distance between the positive antenna feed terminal 96 and the edge of patch 90 may be adjusted to ensure that there is a satisfactory impedance match between patch 90 and transmission line 64. However, such impedance adjustments may not be possible when the antenna is a dual-polarized patch antenna having two feeds. Removing conductive material from parasitic resonating element 140 to form notches 144 may serve to adjust the impedance of patch 90B so that the impedance of patch 90B is matched to both transmission lines 64B-P1 and 64B-P2, for example. Notches 144 may therefore sometimes be referred to herein as impedance matching notches, impedance matching slots, or impedance matching structures.

The dimensions of impedance matching notches 144 may be adjusted (e.g., during manufacture of device 10) to ensure that antenna 40B is sufficiently matched to both transmission lines 64B-P1 and 64B-P2 and to tweak the overall bandwidth of antenna 40B. As an example, notches 144 may have sides with lengths that are equal to between 1% and 40% of dimension V. In order for antenna 40B to be sufficiently matched to transmission lines 64B-P1 and 64B-P2, feed terminals 96B-P1 need to overlap with the conductive material of parasitic element 140. Notches 144 may therefore be suitably small so as not to uncover feed terminals 96B-P1 or 96B-P2. In other words, each of antenna feed terminals 96B-P1 and 96B-P2 may overlap with a respective arm of the cross-shaped parasitic antenna resonating element 140. During wireless communications using device 10, device 10 may use ports P1 and P2 to transmit and/or receive signals with two orthogonal linear polarizations. The example of FIG. 11 is merely illustrative. If desired, patch antenna resonating element 140 may have other shapes or orientations.

Figure 12:
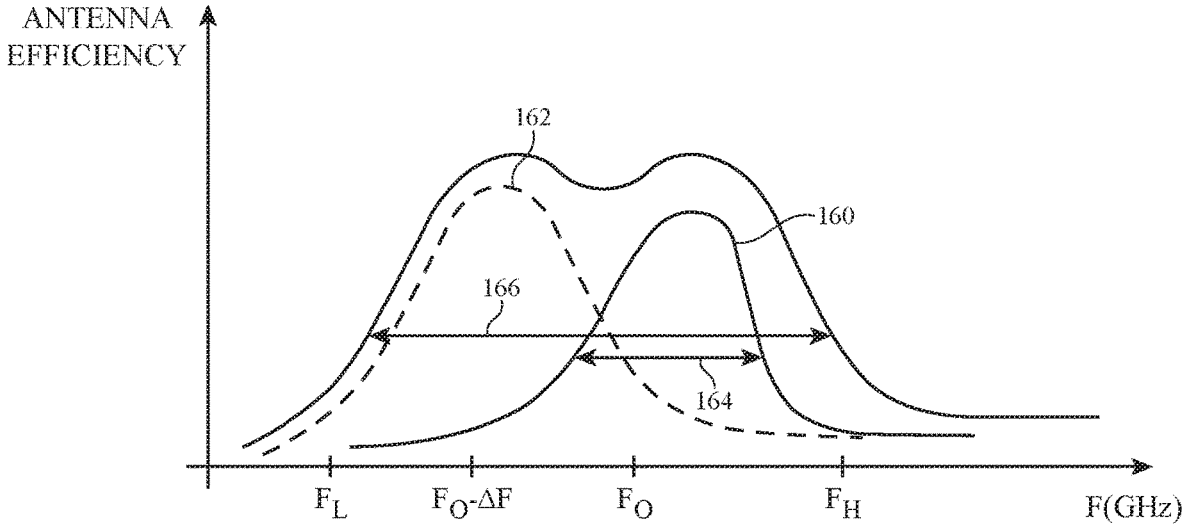
FIG. 12 is a graph of antenna performance (antenna efficiency) for an illustrative patch antenna of the type shown in FIGS. 10 and 11 in accordance with an embodiment.

FIG. 12 is graph in which antenna efficiency has been plotted as a function of operating frequency F for antenna 40B of FIG. 11. As shown in FIG. 12, efficiency curve 160 illustrates the antenna efficiency of patch 90B when operated in the absence of parasitic element 140. Curve 160 may have a peak at frequency $F_0$ and a corresponding bandwidth 164. Bandwidth 164 may be too narrow to cover the entirety of the millimeter wave communications band of interest (e.g., an entire communication band from 57 GHz to 71 GHz).

Efficiency curve 162 illustrates the antenna efficiency of parasitic element 140. Curve 162 may have a peak at frequency $F_0-\Delta F$ that is offset from frequency $F_0$ by offset value $\Delta F$. Efficiency curve 162 illustrates the antenna efficiency of patch 90B combined with the field perturbation provided by parasitic element 140. As shown in FIG. 12, the antenna efficiency of antenna 40B may include contributions from both patch 90B and parasitic 140 such that antenna 40B exhibits an extended bandwidth 166 that is greater than bandwidth 164 of patch 90B in the absence of parasitic 140. Bandwidth 164 may extend between a lower threshold frequency $F_L$ (e.g., 57 GHz) to an upper threshold frequency $F_H$ (e.g., 71 GHz) that define the communications band of interest (e.g., the millimeter wave communications band from 57 GHz to 71 GHz). In this way, antenna 40B may provide coverage for the entirety of the communications band from 57 GHz to 71 GHz (e.g., for performing IEEE 802.11ad communications).

When antennas 40A having co-located antennas 40C are formed in the same array as antennas 40B having parasitic elements 140 (e.g., as shown in FIG. 8), array 60 may cover first, second, and third different communications bands between 10 GHz and 300 GHz. Control circuitry 14 may control array 60 to steer the beam of signals (e.g., millimeter wave and centimeter wave signals in one, two, or each of the first, second, and third communications bands) in a desired direction. For example, when circuitry 70 of FIG. 4 is provided with a first set of phase and amplitude settings, the multi-band beam of signals may be pointed in a first direction. When circuitry 70 is provided with a second set of phase and amplitude settings, the multi-band beam of signals may be pointed in a second direction that is different from the first direction. Array 60 may exhibit a relatively uniform radiation pattern regardless of the direction in which the beam is steered (e.g., as shown by pattern 80 of FIG. 5B).

Figure 13:
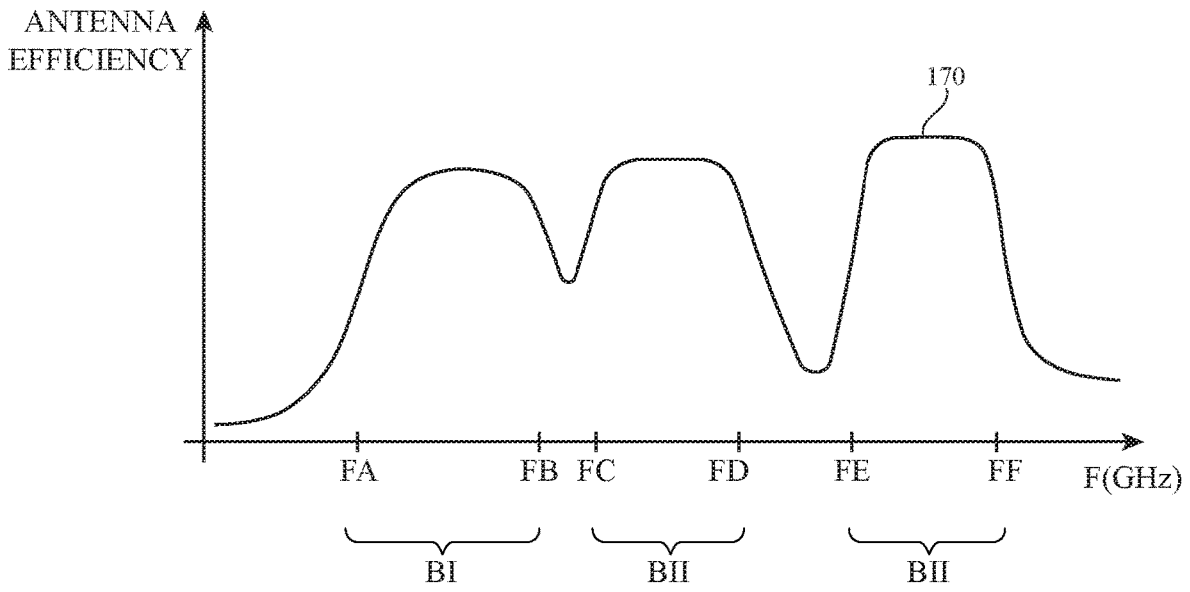
FIG. 13 is a graph of antenna efficiency for an illustrative phased antenna array in accordance with an embodiment.

FIG. 13 is a graph in which antenna performance (antenna efficiency) has been plotted as a function of operating frequency F for phased antenna array 60. As shown in FIG. 13, efficiency curve 170 shows the overall antenna efficiency of array 60 (e.g., including contributions from each of antennas 40A, 40B, and 40C). Efficiency curve 170 may exhibit a first peak in a first communications band BI between frequencies FA and FB due to the contribution of antennas 40A. Efficiency curve 170 may exhibit a second peak in a second communications band BII between frequencies FC and FD due to the contribution of antennas 40C. Efficiency curve 170 may exhibit a third peak in a third communications band BIII between frequencies FE and FF due to the contribution of antennas 40B (e.g., the contribution of patches 90B and corresponding parasitic resonating elements 140). In one suitable example, frequency FA is 27.5 GHz, frequency FB is 28.5 GHz, frequency FC is 37 GHz, frequency FD is 41 GHz, frequency FE is 57 GHz, and frequency FF is 71 GHz. This is merely illustrative and, in general, bands BI, BII, and BIII may be any desired millimeter wave or centimeter wave communications bands and frequencies FA through FF may be any desired frequencies between 10 GHz and 300 GHz (e.g., where frequency FA is less than frequency FB, frequency FB is less than frequency FC, frequency FC is less than frequency FD, frequency FD is less than frequency FE, and frequency FE is less than frequency FF). In this way, array 60 may cover multiple frequency bands greater than 10 GHz while exhibiting a uniform gain regardless of the direction in which the array is steered and without occupying as much space within device 10 as when different arrays are formed for covering different frequencies, for example.

The example of FIG. 13 is merely illustrative. In general, curve 170 may have any desired shape (e.g., as determined by the arrangement of array 60 and the antenna elements therein). If desired, control circuitry 14 may perform simultaneous communications in band BI, band BII, and/or band BIII using array 60 at any given time. If desired, antennas 40A, antennas 40B, and/or antennas 40C may be omitted from array 60. For example, in scenarios where the ring of antennas 40A are omitted, array 60 may only cover bands BII and BIII (e.g., using concentric rings of antennas 40B and 40C). In scenarios where antennas 40B are omitted, array 60 may cover bands BI and BII (e.g., using co-located antennas 40A and 40C or using two concentric rings of antennas 40A and 40C). In scenarios where antennas 40C are omitted, array 60 may cover bands BI and BIII (e.g., using concentric rings of antennas 40A and 40B). In scenarios where antennas 40A and 40C are omitted, array 60 may only cover band BIII (e.g., using a single ring of symmetrically distributed antennas 40B). In scenarios where antennas 40B and 40C are omitted, array 60 may only cover band BI (e.g., using a single ring of symmetrically distributed antennas 40A). In scenarios where antennas 40A and 40B are omitted, array 60 may only cover band BII (e.g., using a single ring of symmetrically distributed antennas 40B). Other arrangements may be used if desired.

The foregoing is merely illustrative and various modifications can be made by those skilled in the art without departing from the scope and spirit of the described embodiments. The foregoing embodiments may be implemented individually or in any combination.

What is claimed is:

1. A phased antenna array, comprising:

a dielectric substrate;

a first set of patch antenna resonating elements on the dielectric substrate and configured to convey radio-frequency signals in a first communications band at frequencies greater than 30 GHz;

a second set of patch antenna resonating elements disposed around the first set of patch antenna resonating elements on the dielectric substrate and configured to convey radio-frequency signals in a second communications band at frequencies that are lower than the first communications band; and a third set of patch antenna resonating elements on the dielectric substrate and configured to convey radio-frequency signals in a third communications band at frequencies that are higher than the second communications band and lower than the first communications band, wherein an entirety of each of the patch antenna resonating elements in the third set of patch antenna resonating element overlaps a respective one of the patch antenna resonating elements in the second set of patch antenna resonating elements.

2. The phased antenna array defined in claim 1, wherein each patch antenna resonating element in the first set is located at a first distance from a point on the dielectric substrate, and each patch antenna resonating element in the second set is located at a second distance from the point on the dielectric substrate, the second distance being greater than the first distance.

3. The phased antenna array defined in claim 2, wherein the first set of patch antenna resonating elements is formed at a first set of angles about the point on the dielectric substrate and the second set of patch antenna resonating elements is formed at a second set of angles about the point on the dielectric substrate, the second set of angles being offset with respect to the first set of angles.

4. The phased antenna array defined in claim 2, wherein the first communications band comprises a communications band between 57 GHz and 71 GHz and the second communications band comprises a communications band between 27.5 GHz and 28.5 GHz.

5. The phased antenna array defined in claim 1, further comprising:

a set of parasitic antenna resonating elements, wherein each parasitic antenna resonating element in the set of parasitic antenna resonating elements overlaps a respective one of the patch antenna resonating elements in the first set.

6. The phased antenna array defined in claim 5, wherein the set of parasitic antenna resonating elements comprises cross-shaped conductive patches.

7. The phased antenna array defined in claim 6, further comprising:

an antenna ground plane coupled to the dielectric substrate, wherein the each patch antenna resonating element in the second set comprises:

a first antenna feed having a first antenna feed terminal coupled to a first location on that patch antenna resonating element and a second antenna feed terminal coupled to the antenna ground plane, and a second antenna feed having a third antenna feed terminal coupled to a second location on that patch antenna resonating element and a fourth antenna feed terminal coupled to the antenna ground plane.

8. The phased antenna array defined in claim 1, wherein the patch antenna resonating elements in the first set are not overlapped by any parasitic antenna resonating elements.

9. The phased antenna array defined in claim 1, wherein the first communications band comprises a communications band between 57 GHz and 71 GHz, the second communications band comprises a communications band between 27.5 GHz and 28.5 GHz, and the third communications band comprises a communications band between 37 GHz and 41 GHz.

10. A phased antenna array, comprising:

a dielectric substrate;

a first set of antennas on the dielectric substrate and configured to transmit and receive wireless signals in a first communications band at frequencies greater than 30 GHz;

a second set of antennas surrounding the first set of antennas on the dielectric substrate and configured to transmit and receive wireless signals in a second communications band at frequencies that are lower than the first communications band;

a third set of antennas on the dielectric substrate and configured to transmit and receive wireless signals in a third communications band at frequencies that are higher than the second communications band and lower than the first communications band, wherein the first set of antennas comprises a first set of patch antenna resonating elements, the second set of antennas comprises a second set of patch antenna resonating elements, and the third set of antennas comprises a third set of patch antenna resonating elements, each of the patch antenna resonating elements in the third set being formed over a respective patch antenna resonating element in the second set of patch antenna resonating elements;

a set of parasitic antenna resonating elements, wherein each parasitic antenna resonating element in the set of parasitic antenna resonating elements is formed over a respective one of the patch antenna resonating elements in the first set of patch antenna resonating elements; and an antenna ground plane for the first, second, and third sets of antennas, wherein the dielectric substrate comprises a first dielectric layer, a second dielectric layer, and a third dielectric layer, the antenna ground plane is formed on the first dielectric layer, the first and second sets of patch antenna resonating elements are formed on the second dielectric layer, and the set of parasitic antenna resonating elements and the third set of patch antenna resonating elements are formed on the third dielectric layer.

11. The phased antenna array defined in claim 10, wherein the set of parasitic antenna resonating elements comprises cross-shaped conductive patches.

12. The phased antenna array defined in claim 10, wherein each antenna in the first set is located at a first distance from a point on the dielectric substrate and each antenna in the second set is located at a second distance from the point on the dielectric substrate, the second distance being greater than the first distance.

13. The phased antenna array defined in claim 12, wherein the first set of antennas is formed at a first set of angles about the point on the dielectric substrate and the second set of antennas is formed at a second set of angles about the point on the dielectric substrate, the second set of angles being offset with respect to the first set of angles.

14. The phased antenna array defined in claim 13, wherein the first communications band comprises a communications band between 57 GHz and 71 GHz, the second communications band comprises a communications band between 27.5 GHz and 28.5 GHz, and the third communications band comprises a communications band between 37 GHz and 41 GHz.

15. A phased antenna array, comprising:

a dielectric substrate;

a ground plane on the dielectric substrate;

a first set of antennas configured to convey radio-frequency signals in a first communications band at frequencies greater than 30 GHz, wherein each antenna in the first set comprises a respective antenna resonating element and a respective parasitic antenna resonating element overlapping that antenna resonating element, the antenna resonating elements in the first set of antennas being interposed between the parasitic antenna resonating elements in the first set of antennas and the ground plane;

a second set of antennas disposed around the first set of antennas and configured to convey radio-frequency signals in a second communications band at frequencies that are lower than the first communications band; and a third set of antennas on the dielectric substrate and overlapping the second set of antennas, wherein the third set of antennas are configured to convey radio-frequency signals in a third communications band at frequencies that are higher than the second communications band and lower than the first communications band, the second and third sets of antennas being free from parasitic antenna resonating elements.

16. The phased antenna array defined in claim 15, wherein the parasitic antenna resonating elements comprise cross-shaped patches.

17. The phased antenna array defined in claim 15, wherein the first communications band comprises a communications band between 57 GHz and 71 GHz, the second communications band comprises a communications band between 27.5 GHz and 28.5 GHz, and the third communications band comprises a communications band between 37 GHz and 41 GHz.

18. The phased antenna array defined in claim 15, wherein the third set of antennas comprise patch antenna resonating elements.

19. The phased antenna array defined in claim 15, wherein the dielectric substrate comprises a plurality of stacked dielectric layers, the patch antenna resonating elements in the third set of antennas and the parasitic antenna resonating elements being patterned on the same dielectric layer in the plurality of stacked dielectric layers.

* * * * *